US007296878B2

(12) United States Patent
Kusakari

(10) Patent No.: US 7,296,878 B2
(45) Date of Patent: Nov. 20, 2007

(54) LIQUID EJECTION HEAD, LIQUID EJECTION APPARATUS AND IMAGE FORMING APPARATUS

(75) Inventor: Tsutomu Kusakari, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 48 days.

(21) Appl. No.: 11/391,270

(22) Filed: Mar. 29, 2006

(65) Prior Publication Data

US 2006/0221110 A1 Oct. 5, 2006

(30) Foreign Application Priority Data

Mar. 30, 2005 (JP) ..... 2005-099071

(51) Int. Cl.
*B41J 2/155* (2006.01)

(52) U.S. Cl. ..... 347/42; 347/19

(58) Field of Classification Search ..... 347/13, 347/42, 15, 43, 19, 41
See application file for complete search history.

(56) References Cited

U.S. PATENT DOCUMENTS

| | | | | |
|---|---|---|---|---|
| 6,921,149 | B2 | 7/2005 | Okuda et al. | |
| 7,008,042 | B2 * | 3/2006 | Niekawa | 347/43 |
| 2002/0101475 | A1 * | 8/2002 | Grose et al. | 347/42 |
| 2004/0150693 | A1 | 8/2004 | Kojima et al. | |
| 2005/0024428 | A1 * | 2/2005 | Matsuo et al. | 347/40 |

FOREIGN PATENT DOCUMENTS

| | | | |
|---|---|---|---|
| JP | 2002-273878 | A | 9/2002 |
| JP | 2004-090504 | A | 3/2004 |
| JP | 2004-167982 | A | 6/2004 |

* cited by examiner

*Primary Examiner*—Lamson Nguyen
(74) *Attorney, Agent, or Firm*—Birch, Stewart, Kolasch & Birch, LLP

(57) ABSTRACT

The liquid ejection head comprises a nozzle surface in which a plurality of nozzles for ejecting droplets of liquid toward an ejection receiving medium are arranged two-dimensionally in conditions satisfying the following relationships: L_pitch=L×k/(n−1), where: k≦m+1; L_pitch is a distance in a first direction on the nozzle surface between a pair of the nozzles that eject the droplets to form dots that are aligned adjacently in a second direction on the ejection receiving medium, the first direction being a direction in which the ejection receiving medium is moved relatively with respect to the liquid ejection head, the second direction being substantially perpendicular to the first direction; L is a maximum distance between the nozzles in the first direction on the nozzle surface; n is a number of the nozzles in the first direction on the nozzle surface, and is an integer not less than 4; m is a number of skipped nozzles indicating a number of nozzles disposed in the first direction within the distance L_pitch between the pair of the nozzles in the first direction and is an integer satisfying 1≦m≦n/2; and k is a positive integer.

13 Claims, 17 Drawing Sheets

LIQUID EJECTION HEAD, LIQUID EJECTION APPARATUS AND IMAGE FORMING APPARATUS

BACKGROUND OF THE INVENTION

1. Field of the Invention

The present invention relates to a liquid ejection head, a liquid ejection apparatus using same, and an image forming apparatus, and more particularly, to a nozzle arrangement structure of a liquid ejection head in which a plurality of ejection ports (nozzles) are arranged two-dimensionally at high density, and an image forming apparatus, such as an inkjet recording apparatus, which forms an image on a recording medium using the liquid ejection head.

2. Description of the Related Art

In the field of inkjet recording apparatuses, in order to print images of high quality at high speed, liquid ejection heads having a plurality of nozzles arranged two-dimensionally (so-called "matrix array heads") have been proposed. FIG. 17 is a plan diagram showing a schematic view of an example of the composition of a matrix array head in the related art. The matrix array head 300 shown in FIG. 17 is a full line type head in which a plurality of nozzles 310 are arrayed two-dimensionally through a length corresponding to the full width of a print medium 302 in the direction (main scanning direction: the direction of arrow M) that is perpendicular to the conveyance direction of the print medium 302 (the sub-scanning direction: the direction of arrow S).

The pressure chambers 312 corresponding to the nozzles 310 are coupled to a common flow channel for ink supply (not shown) through independent supply ports (not shown), in such a manner that ink is filled into the pressure chambers 312 from the common flow channel. Furthermore, pressure generating elements (for example, piezoelectric elements) (not shown) are provided in the pressure chambers 312, and ink droplets can be ejected from the nozzles 310 by controlling the driving of the pressure generating elements in accordance with the print data. By controlling the ink ejection timings of the nozzles while conveying the print medium, it is possible to record a desired image on the print medium.

The matrix array head 300 in the related art has a structure in which a plurality of ink chamber units (liquid droplet ejection elements, each of which forms one recording element unit) 314, each comprising the nozzle 310, the pressure chamber 312 corresponding to the nozzle 310, the pressure generating element, and the like, are arranged in an oblique lattice configuration on the basis of a fixed arrangement pattern of a row direction aligned with the main scanning direction shown in FIG. 17 and an oblique column direction having a uniform angle $\alpha$, which is not perpendicular to the main scanning direction. Taking the distance in the sub-scanning direction between the nozzle columns aligned in the main scanning direction on the nozzle surface 300A (sub-scanning direction nozzle pitch) as $d_{Ns}$, then the effective distance $P_N$ between the nozzles when projected to be aligned in the main scanning direction (the main scanning direction projected nozzle pitch) is $d_{Ns}/\tan\alpha$. By means of this composition, the distance between the dots that are mutually adjacent in the main scanning direction on the print medium 302 is narrowed, thereby improving the recording resolution.

By using the above-described matrix array head 300, it is possible to record an image over the whole surface of the print medium 302, by means of a single sub-scanning action (by performing just one operation of moving the print medium 302 relatively in the sub-scanning direction with respect to the matrix array head 300).

However, the matrix array head 300 in the related art, has a problem in that band-shaped density non-uniformity is liable to occur in the regions of the print medium 302 corresponding to the juncture sections between the nozzle columns (the juncture regions), due to error in the angle of the head in the direction of rotation in the plane of the head surface (error in the rotational position of the head when installed), due to skewed travel of the print medium 302, or the like.

This phenomenon is described with reference to FIG. 18. FIG. 18 shows a case where the head is disposed in a state where it is rotated slightly in the counter-clockwise direction within the plane parallel to the nozzle surface 300A, from the originally intended installation position (the designed reference position), namely, a case where the installed head is tilted with respect to the original main scanning direction. A relatively similar phenomenon also occurs, if the direction of conveyance of the print medium is tilted with respect to a correctly installed head (in the reference position), namely, in a case where the print medium is conveyed in a skewed or meandering fashion in the direction of the arrow S' in FIG. 18.

As shown in FIG. 18, if the matrix array head 300 is installed with error in the rotational position (and/or the print medium is conveyed with a certain angle of inclination with respect to the sub-scanning direction due to skewed or meandering travel), then the distance Pm in the main scanning direction between the dots $D_A$ and $D_B$ formed on the print medium by droplets ejected from a pair of nozzles at the junction between the nozzle columns indicated by A and B in FIG. 18 (in the juncture region), is greater than the distance between other mutually adjacent dots in the main scanning direction (see the enlarged diagram in FIG. 19). Consequently, banding of a lower density occurs at a position on the print medium corresponding to the nozzle pair A and B in this juncture region. If the direction of rotation of the relative angular error between the matrix array head 300 and the print medium is the opposite direction, then the distance in the main scanning direction between the adjacent dots formed by droplets ejected onto the print medium by the nozzles in the juncture region is reduced, and therefore banding in which the recording density on the print medium becomes higher occurs correspondingly to the positions of the juncture regions.

Various methods have been proposed in order to reduce the perceivability of the density non-uniformity occurring at junctions (juncture regions) between nozzle columns (see Japanese Patent Application Publication Nos. 2004-167982, 2002-273878, and 2004-90504).

Japanese Patent Application Publication No. 2004-167982 discloses that nozzles are arranged in such a manner that sizes of the droplets ejected from the nozzles arranged in the sub-scanning direction are varied in an oscillating fashion, and that nozzles are arranged in such a manner that the positions of the nozzles in the main scanning direction are varied in an oscillating fashion. Accordingly, it is possible to reduce non-uniformity occurring at the same frequency as the juncture regions between nozzle columns in the matrix configuration. Furthermore, Japanese Patent Application Publication No. 2004-167982 discloses that non-uniformity is made to less perceivable by arranging nozzles in such a manner that the spatial frequency of the juncture regions of the matrix arrangement is a high frequency, which is not readily perceivable.

However, in this technology, it is not possible to reduce the error in the distance between dots occurring in the region where banding occurs, and hence there is a problem in that a large local difference in density occurs. Furthermore, since the dot diameters are intentionally made to be non-uniform, then the homogeneity of the print results is lost. In other words, this only allows the perceivability of the periodic non-uniformity at the juncture regions to be reduced by adding a new non-uniformity (variation) of a different frequency, by varying the dot sizes and varying the dot positions, in response to the original problem to be solved, namely, the periodic non-uniformity at the juncture regions.

Japanese Patent Application Publication No. 2002-273878 discloses a line type inkjet head in which nozzles are arranged in a column shape (linearly in one column or two columns) on a head chip, and a plurality of head chips are arranged in the line arrangement direction of the head on a single substrate in an oblique state where the nozzle arrangement direction of each head chip forms a prescribed angle with respect to the line arrangement direction. The technology disclosed in Japanese Patent Application Publication No. 2002-273878 aims to improve manufacturing accuracy and to reduce non-uniformity occurring at the junction regions between columns, by arranging the plurality of head chips on the single substrate.

However, this technology can reduce only the non-uniformity that occurs due to error in the nozzle arrangement, and it does not enable reduction of non-uniformity occurring due to inclination within the plane of the head, or skewed travel of the medium, or the like.

Japanese Patent Application Publication No. 2004-90504 discloses that the perceivability of non-uniformity can be reduced through altering the frequency of the non-uniformity by arranging nozzles in such a manner that droplets are ejected to form dots of a different diameter, between dots of the same diameter aligned in the main scanning direction on the print medium.

However, this technology requires a composition in which dots of different diameters can be ejected, and the like. Furthermore, since it simply changes the spatial frequency of the non-uniformity, there is large error in the dot pitch when viewed on a micro level, and hence there is a large difference between the actual print result and the ideal print result.

SUMMARY OF THE INVENTION

The present invention has been contrived in view of the foregoing circumstances, an object thereof being to provide a liquid ejection head, a liquid ejection apparatus using same, and an image forming apparatus, whereby non-uniformity occurring as a result of skewed travel of the medium, or error in the head installation position due to rotation within the plane of the head, can be reduced.

In order to attain the aforementioned object, the present invention is directed to a liquid ejection head comprising a nozzle surface in which a plurality of nozzles for ejecting droplets of liquid toward an ejection receiving medium are arranged two-dimensionally in conditions satisfying the following relationships: $L_pitch=L\times k/(n-1)$, where: $k\leqq m+1$; L_pitch is a distance in a first direction on the nozzle surface between a pair of the nozzles that eject the droplets to form dots that are aligned adjacently in a second direction on the ejection receiving medium, the first direction being a direction in which the ejection receiving medium is moved relatively with respect to the liquid ejection head, the second direction being substantially perpendicular to the first direction; L is a maximum distance between the nozzles in the first direction on the nozzle surface; n is a number of the nozzles in the first direction on the nozzle surface, and is an integer not less than 4; m is a number of skipped nozzles indicating a number of nozzles disposed in the first direction within the distance L_pitch between the pair of the nozzles in the first direction and is an integer satisfying $1\leqq m\leqq n/2$; and k is a positive integer.

According to the present invention, since there are no singular nozzle pairs having a markedly enlarged nozzle distance in the first direction between the pair of nozzles that eject droplets to form adjacent dots that are aligned in the second direction on the ejection receiving medium, then even if error occurs in the relative angle between the head and the print medium, it is possible to reduce the error which arises in the dot pitch in the dots aligned adjacently in the second direction, on the ejection receiving medium. Accordingly, it is possible to reduce non-uniformity arising due to error in the head installation position in a rotational direction, or skew error in the conveyance of the medium, due to skewed travel or meandering travel of the ejection receiving medium, or angular error caused by a combination of these factors (hereinafter, these errors are referred to generally as "rotational error").

In order to attain the aforementioned object, the present invention is also directed to a liquid ejection head comprising a nozzle surface in which a plurality of nozzles for ejecting droplets of liquid toward an ejection receiving medium are arranged two-dimensionally, wherein: a first direction is a direction in which the ejection receiving medium is moved relatively with respect to the liquid ejection head, and a second direction being substantially perpendicular to the first direction; second direction nozzle rows constituted by the nozzles arranged linearly on the nozzle surface in the second direction are formed in n rows at mutually different positions on the nozzle surface in terms of the first direction, where n is an integer not less than 4; m rows of the second direction nozzle rows are disposed within a distance in the first direction on the nozzle surface between a pair of the nozzles that eject the droplets to form dots that are aligned adjacently in the second direction on the ejection receiving medium, where m is an integer satisfying $1\leqq m\leqq n/2$; the liquid ejection head is capable of forming a second direction dot line of dots aligned in the second direction on the ejection receiving medium by depositing the droplets ejected from the nozzles in each of the n rows onto the ejection receiving medium, while moving the ejection receiving medium relatively with respect to the liquid ejection head in the first direction; and a jagged line nozzle arrangement is adopted, in which, when the nozzles in the nozzle surface which correspond to the dots are tracked following an alignment sequence of the dots that are mutually adjacent in the second direction in respect of a continuous group of n dots formed of the droplets ejected from the nozzles in each of the n rows in the second direction dot line, then nozzle lines comprising nozzle groups in which the nozzle which ejects the droplet forming a next dot in the alignment sequence is positioned on an upstream side in terms of the first direction, and nozzle lines comprising nozzle groups in which the nozzle which ejects the droplet forming the next dot in the alignment sequence is positioned on a downstream side in terms of the first direction, are combined together in a form of a jagged line.

According to the present invention, it is possible to form the second direction dot line on the ejection receiving medium by ejecting the droplets sequentially from the second direction nozzle rows having n rows, in conjunction with the relative movement of the ejection receiving medium with respect to the liquid ejection head. This second direction dot line is formed by linking together, in the second direction, repetition units, each comprising a group of dots aligned linearly and adjacently on the ejection receiving medium and formed by n dots ejected from the nozzles of each row of the second direction nozzle rows, from the first row to the n-th row (in other words, a line-shaped dot group comprising n continuous dots).

Looking at these repetition units in particular (namely, the groups of n dots aligned continuously in the second direction on the ejection receiving medium), then the path traced when the nozzles corresponding to the respective dots are tracked on the nozzle surface, following the alignment sequence of the dot group (in other words, the line which links the nozzles in accordance with the nozzle arrangement), is a jagged shape having at least one juncture region where the direction of inclination is reversed, such as a V shape or a W shape.

According to this composition, since there are no singular nozzle pairs having a markedly enlarged nozzle distance in the first direction between the pair of nozzles that eject droplets to form adjacent dots that are aligned in the second direction on the ejection receiving medium, then it is possible to reduce non-uniformity occurring due to rotational error.

Preferably, the plurality of nozzles are arranged two-dimensionally in conditions satisfying the following relationships: $L_pitch=L\times k/(n-1)$, where: $k\leqq m+1$; L_pitch is the distance in the first direction on the nozzle surface between the pair of the nozzles that eject the droplets to form the dots that are aligned adjacently in the second direction on the ejection receiving medium; L is a maximum distance between the nozzles in the first direction on the nozzle surface; and k is a positive integer.

According to this aspect of the present invention, it is possible to achieve a high-density nozzle arrangement, as well as suppressing the occurrence of non-uniformities due to rotational error.

In order to attain the aforementioned object, the present invention is also directed to a liquid ejection apparatus, comprising: the above-described liquid ejection head; a conveyance device which produces a relative movement of the ejection receiving medium in the first direction with respect to the liquid ejection head, by conveying at least one of the liquid ejection head and the ejection receiving medium; and an ejection control device which implements control in order to eject the droplets of the liquid from the nozzles of the liquid ejection head, in accordance with the relative movement produced by the conveyance device.

According to the present invention, it is possible to achieve a liquid ejection apparatus capable of reducing the occurrence of non-uniformities due to rotational error.

Preferably, the liquid ejection apparatus further comprises an ejection correction device which: when forming a second direction dot line of dots aligned in the second direction on the ejection receiving medium by depositing the droplets ejected from the nozzles onto the ejection receiving medium, while moving the ejection receiving medium relatively with respect to the liquid ejection head in the first direction by the conveyance device, and when the nozzles in the nozzle surface which correspond to the dots are tracked following an alignment sequence of the dots that are mutually adjacent in the second direction in the second direction dot line, then divides the nozzles into a nozzle group in which the nozzle which ejects the droplet forming a next dot in the alignment sequence is positioned on an upstream side in terms of the first direction, and a nozzle group in which the nozzle which ejects the droplet forming the next dot in the alignment sequence is positioned on a downstream side in terms of the first direction, and corrects an ejection state for each of the nozzle groups.

The directions of the increase and reduction of the dot pitch in the second direction on the ejection receiving medium, with respect to rotational error, are opposite between the nozzle group in which the nozzle which ejects the droplet forming the next dot in the alignment sequence of the dots that are mutually adjacent in the second direction in the second direction dot line is positioned on the upstream side in terms of the first direction, and the nozzle group in which the nozzle which ejects the droplet forming the next dot in the alignment sequence is positioned on the downstream side in terms of the first direction.

In regions where droplets are ejected by the nozzle groups in which the dot pitch in the second direction on the ejection receiving medium has increased as a result of rotational error, the dot density tends to fall and therefore, it is desirable to perform correction which increases the ejection volume (or the number of ejected droplets) in such nozzle groups.

On the other hand, in regions where droplets are ejected by the nozzle groups in which the dot pitch in the second direction on the ejection receiving medium has decreased as a result of rotational error, the dot density tends to increase and therefore, it is desirable to perform correction which reduces the ejection volume (or the number of ejected droplets) in such nozzle groups.

Thus, by correcting the ejection state for each nozzle group, in accordance with the change in the tendency of the dot pitch in the second direction to increase or decrease in response to rotational error, it is possible to reduce non-uniformities yet further.

Preferably, the liquid ejection apparatus further comprises: a head angle determination device which determines an installation angle of the liquid ejection head; and a correction amount control device which controls an amount of correction for correcting the ejection state, according to a determination result of the head angle determination device.

Alternatively, it is also preferable that the liquid ejection apparatus further comprises: a medium angle determination device which determines an angle of conveyance direction of the ejection receiving medium by the relative movement with respect to the liquid ejection head; and a correction amount control device which controls an amount of correction for correcting the ejection state, according to a determination result of the medium angle determination device.

A desirable mode is one in which the amount of the rotational error is ascertained by means of the head angle determination device, or the medium angle determination, or a combination of these devices, and the amount of correction applied to droplet ejection is controlled suitably, for each nozzle group, in accordance with this amount of error.

In order to attain the aforementioned object, the present invention is also directed to an image forming apparatus, comprising the above-described liquid ejection apparatus, and forming an image on the ejection receiving medium by means of ink liquid ejected from the nozzles.

In order to achieve a high-resolution image output, a desirable mode is one using a liquid ejection head (print head) in which a plurality of liquid droplet ejection elements (ink chamber units) are arranged at high density, each liquid droplet ejection element being constituted by an ejection port (nozzle) which ejects ink liquid, and a pressure chamber and pressure generating element corresponding to the nozzle.

One compositional embodiment of a liquid ejection head for printing of this kind is a full line type head in which a plurality of nozzles are arranged through a length corresponding to the full width of the ejection receiving medium. A full line type head is usually disposed in a direction that is perpendicular to the relative feed direction (relative conveyance direction) of the ejection receiving medium (the recording medium, such as recording paper), but a mode may also be adopted in which the head is disposed following an oblique direction that forms a prescribed angle with respect to the direction perpendicular to the conveyance direction.

When forming color images by means of an inkjet liquid ejection head, it is possible to provide heads for each color of a plurality of colored inks, or it is possible to eject inks of a plurality of colors, from one head.

The "ejection receiving medium" is a medium which receives the deposition of liquid ejected from the nozzles of the liquid ejection head, and in an image forming apparatus, this corresponds to a recording medium, such as recording paper. More specifically, the "ejection receiving medium" indicates a recording medium, print medium, image forming medium, image receiving medium, or the like. This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The conveyance device for causing the ejection receiving medium and the liquid ejection head to move relatively to each other may include a mode where the ejection receiving medium is conveyed with respect to a stationary (fixed) head, or a mode where a head is moved with respect to a stationary ejection receiving medium, or a mode where both the head and the ejection receiving medium are moved.

According to the present invention, it is possible to reduce non-uniformity occurring as a result of error in the installation position of the head due to rotation, or skewed travel of the medium, or the like.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 8A and 8B are diagrams showing an embodiment of a device for ascertaining the rotational error, in which FIG. 8A is a plan view and FIG. 8B is a side view;

DETAILED DESCRIPTION OF THE PREFERRED EMBODIMENTS

First Embodiment

Structure of Liquid Ejection Head

Figure 1:
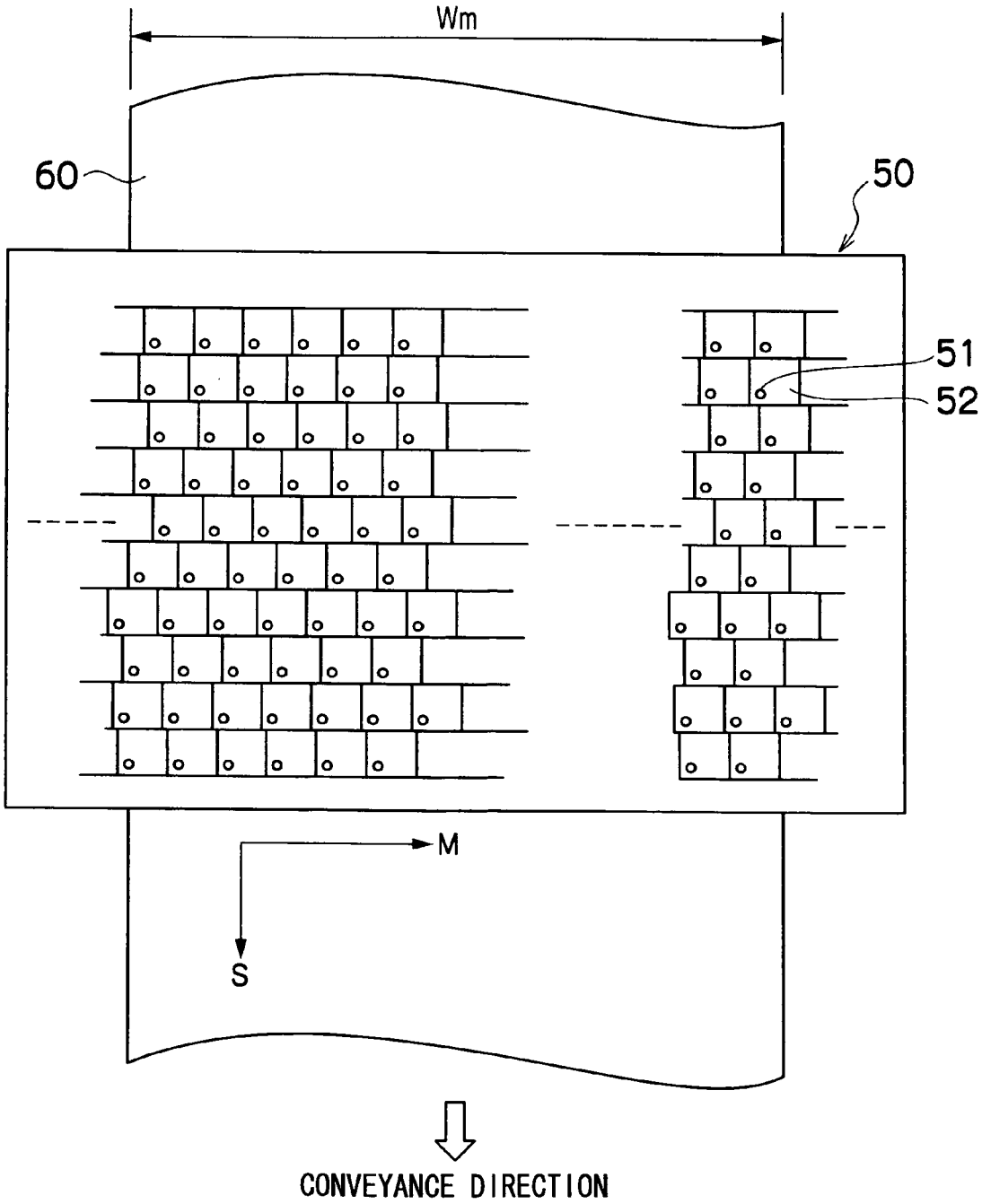
FIG. 1 is a plan diagram showing a schematic drawing of the structure of a liquid ejection head according to a first embodiment of the present invention.

FIG. 1 is a plan diagram showing a schematic drawing of the structure of a liquid ejection head according to a first embodiment of the present invention. The head 50 shown in FIG. 1 is a full line type of print head used in an inkjet recording apparatus (also called a recording head or a print head), and it has a structure in which a plurality of nozzles 51 are arranged two-dimensionally through a length corresponding to the full width $W_m$ of the print medium 60 in a direction (main scanning direction: indicated by arrow M) which is perpendicular to the conveyance direction of the print medium 60 (the sub-scanning direction: indicated by arrow S). In FIG. 1, a pressure chamber corresponding to one of the nozzles 51 is denoted with reference numeral 52. Furthermore, it is supposed that the print medium 60 is conveyed from top to bottom in FIG. 1.

Figure 2:
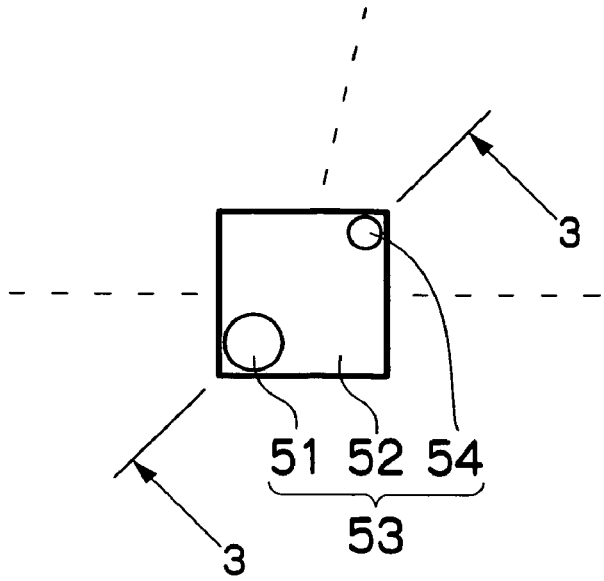
FIG. 2 is an enlarged view of one liquid droplet ejection element (ink chamber unit corresponding to one nozzle)
Figure 3:
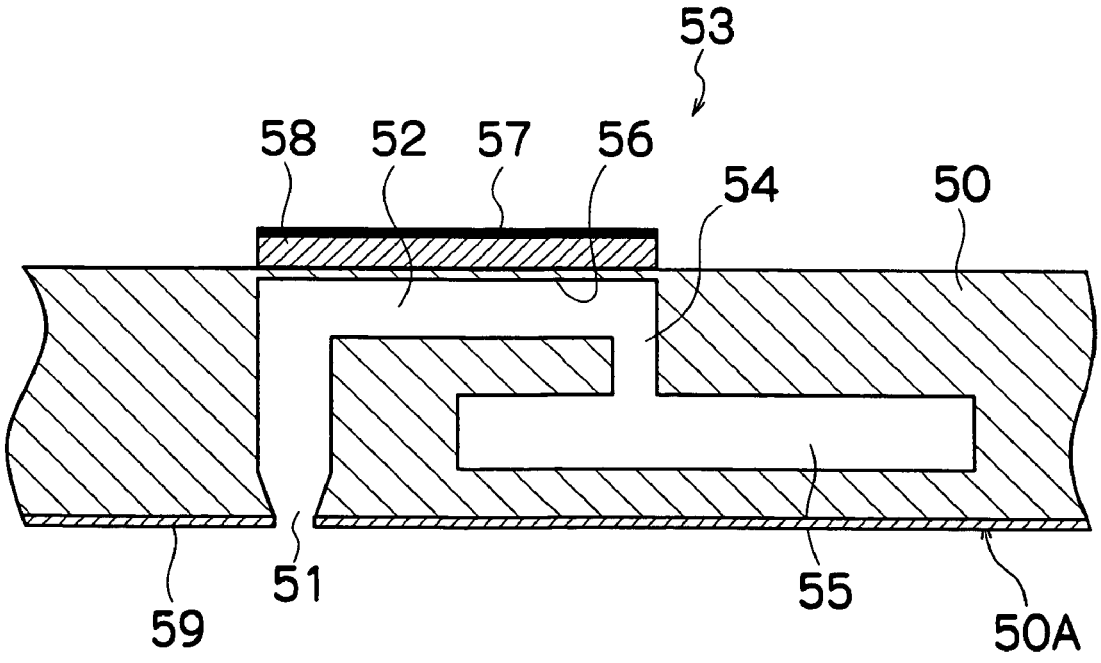
FIG. 3 is a cross-sectional view along line 3-3 in FIG. 2.

FIG. 2 is an enlarged diagram of one liquid droplet ejection element (the ink chamber unit corresponding to one nozzle) 53, and FIG. 3 is a cross-sectional diagram along line 3-3 in FIG. 2. As shown in FIG. 2, the planar shape of the pressure chamber 52 provided corresponding to each nozzle 51 is substantially a square shape, and an outlet port (nozzle flow channel) to the nozzle 51 is provided at one of the ends of the diagonal line of the planar shape, while an inlet port (supply port) 54 for supplying ink is provided at the other end thereof. In implementing the present invention, the shape of the pressure chamber 52 is not limited to that of the present embodiment and various modes are possible in which the planar shape is another quadrilateral shape (rhombic shape, rectangular shape, or the like), a pentagonal shape, a hexagonal shape, or another polygonal shape, or a circular shape, elliptical shape, or the like.

As shown in FIG. 3, each pressure chamber 52 is connected to a common flow channel 55 through the supply port 54. The common flow channel 55 is connected to an ink tank (not shown), which is a base tank that supplies ink, and the ink supplied from the ink tank is delivered through the common flow channel 55 to the pressure chambers 52.

An actuator 58 provided with an individual electrode 57 is bonded to a pressure plate (a diaphragm that also serves as a common electrode) 56 which forms the surface of one portion (in FIG. 3, the ceiling) of the pressure chambers 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 52 is replenished with new ink from the common flow channel 55 through the supply port 54.

A nozzle surface 50A of the head 50 has a liquid-repelling layer 59, from the viewpoint of improving ejection stability and the cleaning properties of the ejection surface (nozzle surface 50A). There are no particular restrictions on the method for imparting liquid repelling properties to the nozzle surface 50A (the liquid repelling process method), and possible methods include, for example, a method involving coating with a fluoropolymer liquid repelling material, or a method involving the formation of a thin layer on the nozzle surface by vapor deposition of a liquid repelling material, such as particles of a fluoropolymer (e.g., polytetrafluoroethylene (PTFE)), in a vacuum.

By controlling the driving of the actuators 58 corresponding to the nozzles 51 in accordance with the print data, it is possible to eject ink droplets from the nozzles 51. As shown in FIG. 1, by controlling the ink ejection timing of the nozzles 51 in accordance with the speed of conveyance of the print medium 60, while conveying the print medium 60 in the sub-scanning direction at a uniform speed, it is possible to record a desired image on the print medium 60.

In FIG. 3, a method is employed in which an ink droplet is ejected by means of the deformation of the actuator 58, which is typically a piezoelectric element. However, in implementing the present invention, the method used for ejecting ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 4:
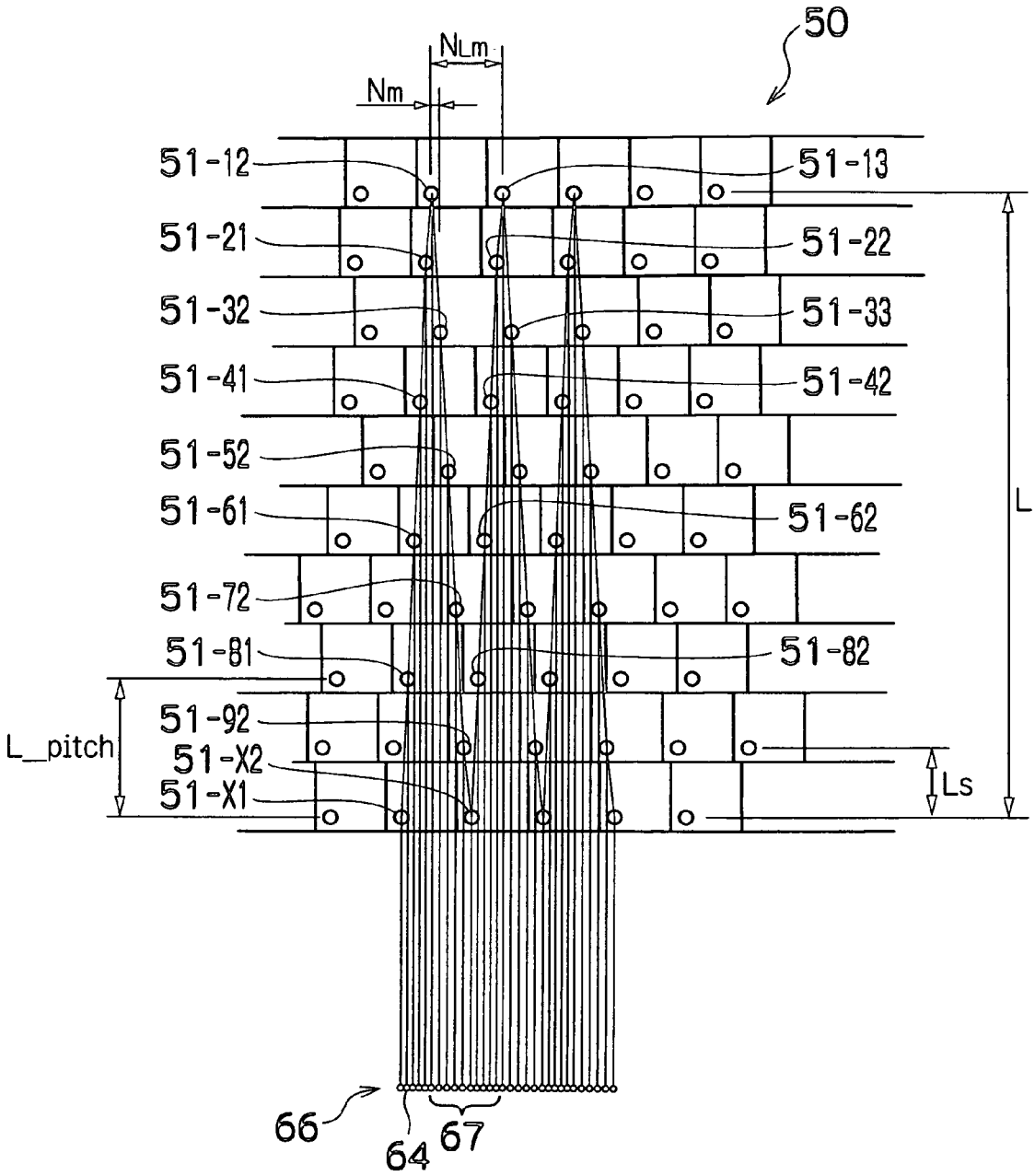
FIG. 4 is an enlarged view of the two-dimensional nozzle arrangement of the head shown in FIG. 1.
Figure 18:
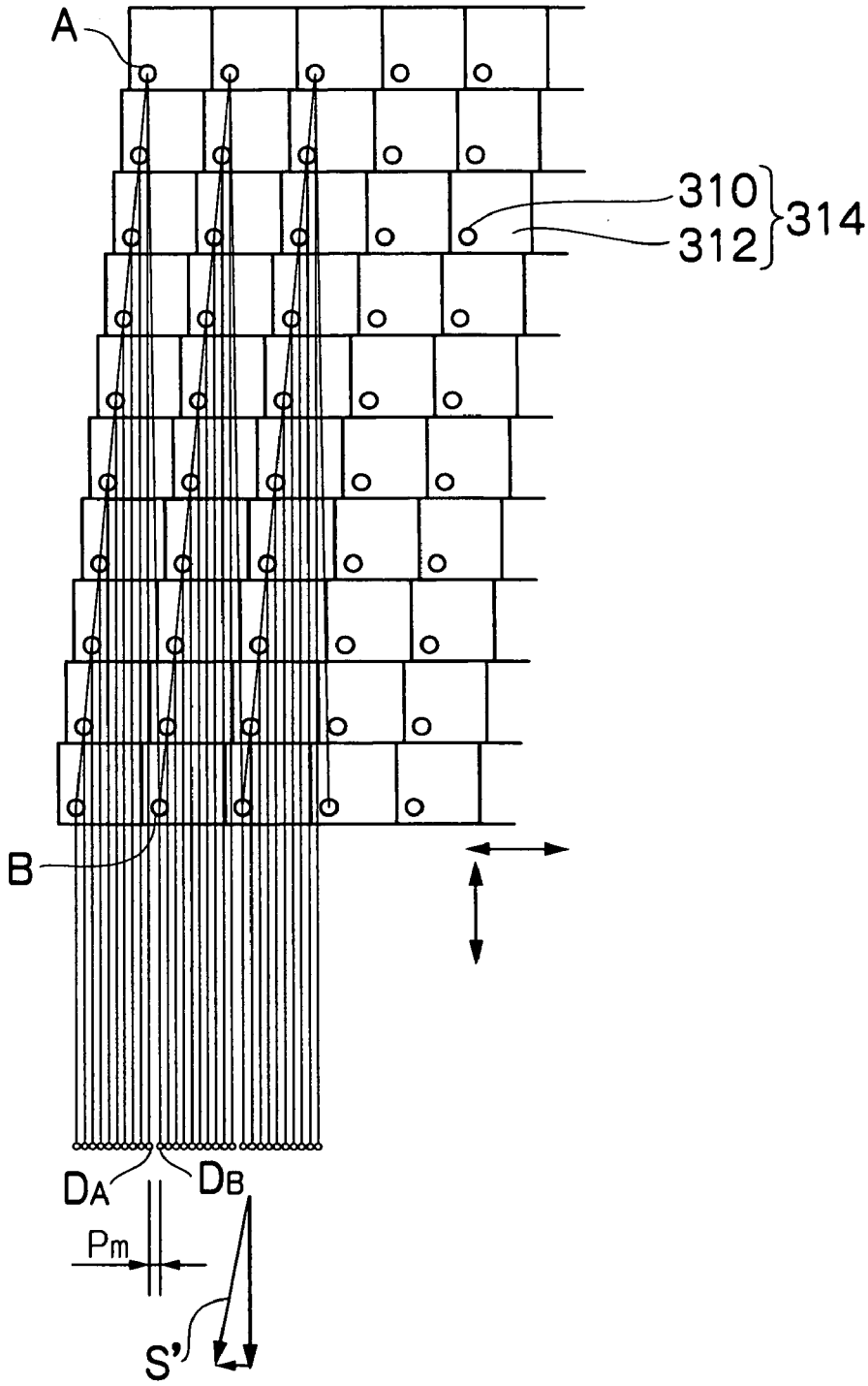
FIG.18 RELATED ART
FIG. 18 is an enlarged view of a nozzle arrangement in a matrix array head in the related art.

FIG. 4 is an enlarged view of the two-dimensional nozzle arrangement of the head 50 shown in FIG. 1. The high-density nozzle head according to the present embodiment (indicated by reference numeral 50 in FIG. 1) is achieved by arranging the ink chamber units 53 having the structure shown in FIGS. 2 and 3, in a two-dimensional configuration as shown in FIG. 4. In FIG. 4, in order to facilitate comparison with the composition in the related art shown in FIG. 18, a case having the same amount of rotational error as FIG. 18 is described (namely, the same amount of inclination of the head, or the same amount of skewed travel or meandering travel of the medium).

In the two-dimensional nozzle arrangement of the head 50 shown in FIG. 4, in order to simplify the description, the lateral direction in FIG. 4 (main scanning direction) is taken as the row direction and the longitudinal direction (sub-scanning direction) is taken as the column direction, and the row numbers (i=1 to 10) are determined in sequence, from the top down in FIG. 4, as the 1st row, 2nd row, . . . , to the 10th row. Furthermore, the column numbers (j=1, 2, . . . , J) are determined from left to right for the nozzle columns aligned linearly in the column direction (substantially the longitudinal direction), and the position of each nozzle 51 is represented by "51-*ij*", using a combination of the row number i and the column number j. In a case where i=10, the notation "51-Xj" is used in order to simplify the description.

In the present embodiment, the number of nozzles (number of rows) n in the sub-scanning direction is taken to be ten, but in implementing the present invention, the number of nozzles (number of rows) in the sub-scanning direction, n, is not limited to being n=10. However, due to the reasons described below, it is presumed that n is an integer equal to four or above.

The nozzle pitch $N_{Lm}$ in the main scanning direction is uniform within the rows (the nozzle pitch in the main scanning direction in each row is a constant value of $N_{Lm}$ in all of the nozzles), and the nozzles 51-*ij* of the rows are arranged in a staggered fashion by varying the nozzle positions in the main scanning direction, between the rows. In other words, when the number of nozzle rows in the head 50 (the number of nozzles in the sub-scanning direction) is n (in the case of FIG. 4, n=10), and the effective nozzle pitch in the main scanning direction of the nozzles which eject droplets to form dots that are aligned in the main scanning direction on the print medium is $N_m$, then the relationship $N_{Lm}=n\times N_m$ is satisfied. Furthermore, the distance $L_s$ between the rows in the sub-scanning direction (the column direction in the nozzle arrangement) (in other words, the distance between the nozzles in the sub-scanning direction) is constant, and the maximum distance between the nozzles in the sub-scanning direction is L, where $L=n\times L_s$.

In the embodiment shown in FIG. 4, the nozzle positions in the main scanning direction are shifted between the columns respectively by $N_m$ in the rightward direction in FIG. 4, with respect to the alignment of the nozzles 51-1*j* of the first row, in the sequence: 1st row→3rd row→5th row→7th row→9th row→10th row→8th row→6th row→4th row→2nd row.

In the nozzle arrangement shown in FIG. 4, the droplet ejection timing from the nozzles 51-*ij* is controlled in synchronism with the conveyance of the print medium, and the nozzles 51-*ij* in the respective rows are driven sequentially in the sequence, 1st row→2nd row→3rd row→ . . . 10th row, thereby causing a single line of dots (main scanning direction dot line) 66 to be printed, in which the dots 64 are arranged linearly in the breadthways direction of the print medium (main scanning direction).

If the nozzle numbers corresponding to the dots 64 are tracked, following the alignment sequence of the dots 64 formed on the print medium in a mutually adjacent alignment in the main scanning direction, from left to right in FIG. 4, then the corresponding nozzle sequence is 51-X1→51-81→51-61→51-41→51-21→51-12→51-32→51-52→51-72→51-92→51-X2→51-82→51-62→51-42→51-22→51-13→51-33→ . . . . In this way, the nozzle arrangement pattern formed by sequentially linking the nozzles 51-*ij* corresponding to the dots 64 in the dot line 66 in the main scanning direction, following the alignment sequence of the dots 64, is a jagged W-shaped line (triangular wave shape). In other words, the effective arrangement on the nozzle surface 50A of the nozzles 51-*ij* that eject dots 64 that are aligned mutually adjacently in the main scanning direction on the print medium is a jagged nozzle row in the shape of a W (triangular wave shape).

This nozzle arrangement is repeated cyclically in the main scanning direction. Taking the nozzles 51-1*j* of the first row as the starting point, then looking specifically at the row number of the nozzles 51-*ij* corresponding to the alignment sequence of the dots 64 in the dot line 66 in the main scanning direction, the following sequence is repeated: 1st row→3rd row→5th row→7th row→9th row→10th row→~8th row→6th row→4th row→2nd row→1st row→ . . . .

Looking at the dot line 66 in the main scanning direction printed on the print medium, it can be seen that this dot line 66 is formed by joining together, in the main scanning direction, respective dot groups 67, each forming a repetition unit comprising a group of dots that are aligned linearly in a mutually adjacent fashion on the print medium and are formed by n dots 64 formed of droplets ejected from the nozzles in the rows of 1st row→3rd row→5th row→7th row→9th row→10th row→8th row→6th row→4th row→2nd row (in other words, a line-shaped dot group formed by a continuous sequence of n dots) 67.

Looking at the repetition unit (one cycle) in the nozzle arrangement, which corresponds to the dot group 67, it can be seen that the line sequentially linking the nozzles of the rows, 1st row→3rd row→5th row→7th row→9th row→10th row (corresponding to the nozzle line in the first half of the repetition unit; the nozzle line aligned substantially linearly in the rightward and downward direction in FIG. 4) turns back in a V shape at the position of the nozzle in the 10th row, and after turning back, it joins to a line sequentially linking the nozzles of the rows, 10th row→8th row→6th row→4th row→2nd row→1st row (corresponding to the nozzle line in the second half of the repetition unit; the nozzle line aligned substantially linearly in the rightward and upward direction in FIG. 4). By repeating this V-shaped repetition unit a plurality of times in the main scanning direction, a W-shaped series of nozzle lines are formed.

According to the nozzle arrangement shown in FIG. 4, the nozzle distance L_pitch in the sub-scanning direction between a pair of nozzles that eject droplets to form dots that are aligned adjacently in the main scanning direction on the print medium has the minimum value of $L_s$, and the maximum value of $2\times L_s$. Here, $L_s$ is the nozzle distance in the sub-scanning direction between two pressure chambers which are aligned adjacently in the sub-scanning direction in the print head.

Figure 17:
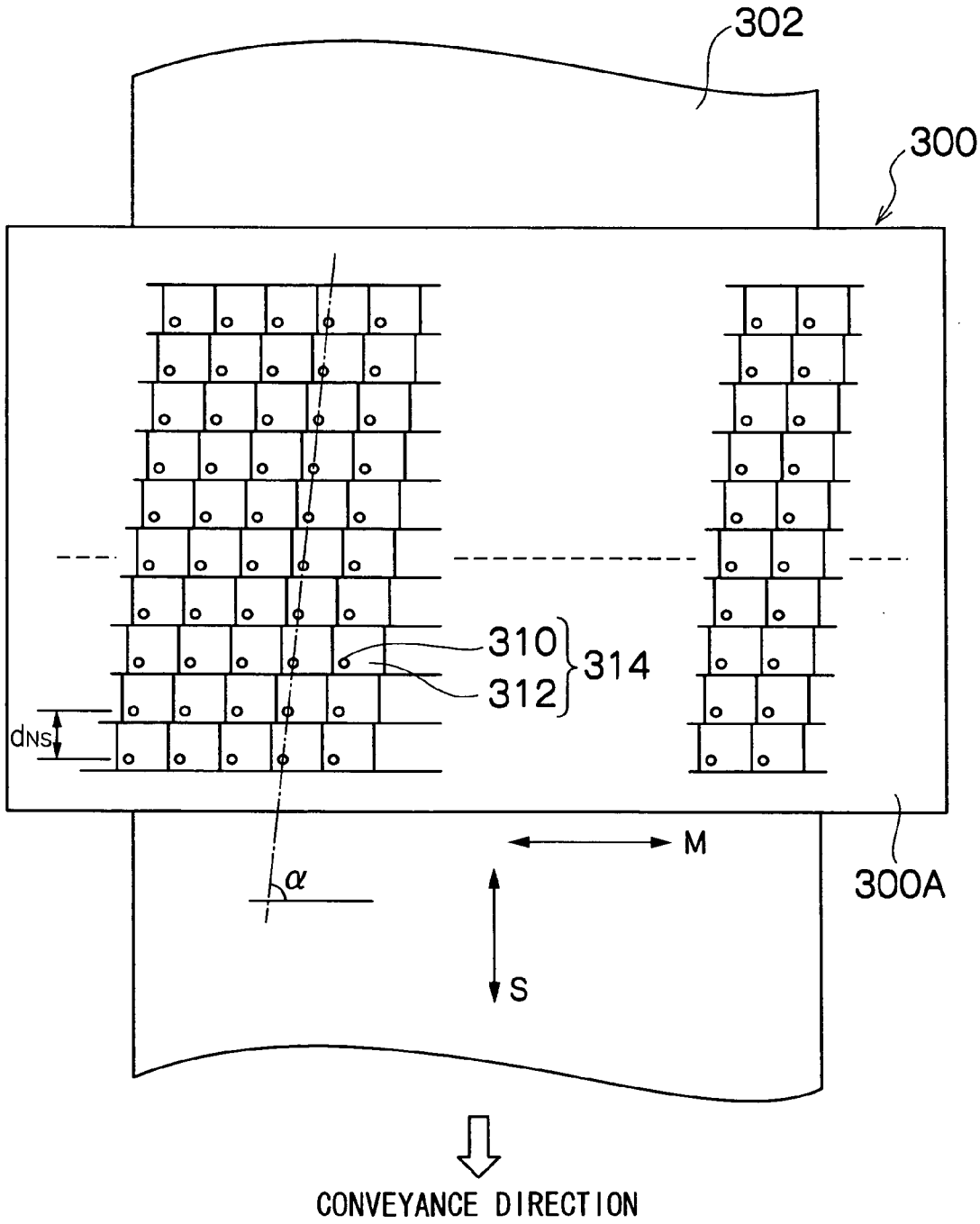
FIG.17 RELATED ART
FIG. 17 is a plan diagram showing a schematic view of an embodiment of the composition of a matrix array head in the related art.
Figure 19:
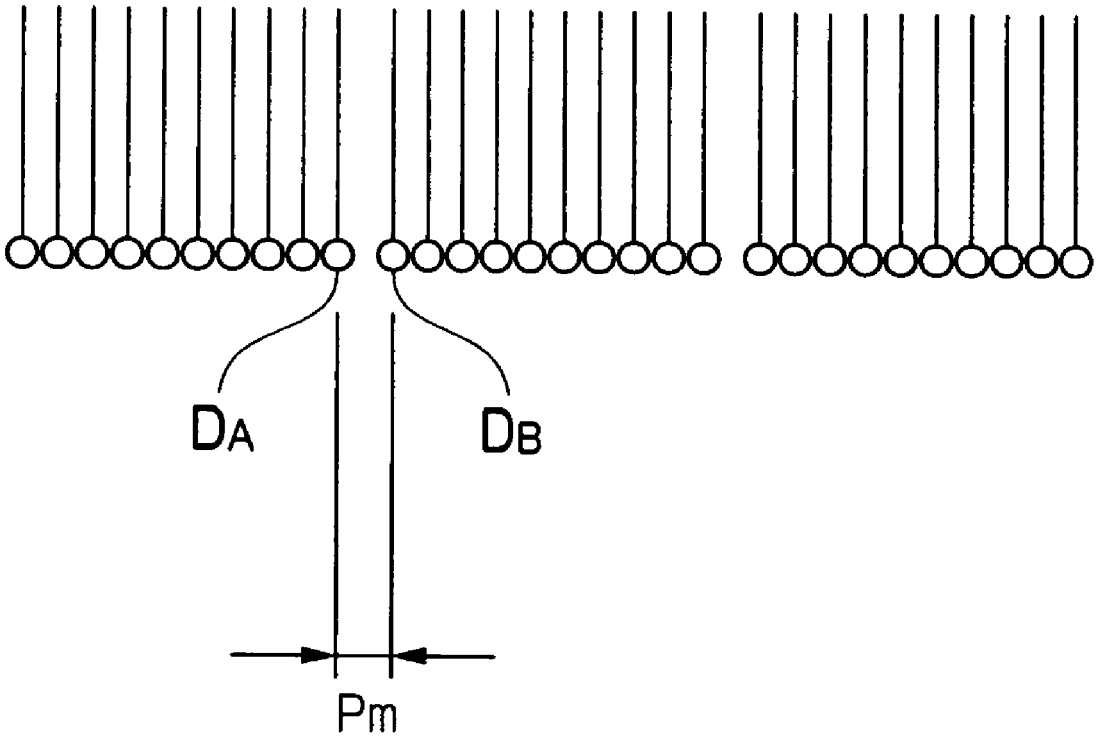
FIG.19 RELATED ART
FIG. 19 is an enlarged view of a dot line in the main scanning direction, shown in FIG. 18.

On the other hand, in the composition in the related art shown in FIGS. 17 to 19, if the nozzles corresponding to the dots are tracked following the sequence of the dots formed of the droplets ejected so as to be aligned adjacently in the main scanning direction on the print medium, then the nozzles from the first row to the tenth row are arranged in a single straight line in an oblique direction (an upward and rightward direction in FIG. 18) on the ejection surface, and the nozzle line turns back suddenly from the nozzle in the tenth row to the nozzle in the first row. In a nozzle arrangement in the related art having a saw-tooth shape of this kind, the nozzle distance in the sub-scanning direction between a pair of nozzles that eject droplets to form dots aligned adjacently in the main scanning direction on the print medium has the minimum value of $L_s$ and the maximum value of $10\times L_s$, and hence the difference between these two values is very large. Consequently, in the head in the related art, if there is an error in the installation position of the head in terms of rotation within the plane of the head, or if skewed travel of the medium occurs, or the like, then non-uniformity occurs in the positions on the print medium that correspond to the nozzle pairs having this maximum value (namely, the nozzle pairs in the juncture sections), as described previously.

In this respect, according to the embodiment shown in FIGS. 1 to 4, since there is a small variation (difference between the minimum value and the maximum value) of the nozzle distances in the sub-scanning direction between pairs of nozzles that eject droplets to form dots aligned adjacently in the main scanning direction on the print head, then even if there is an error in the installation position of the head in terms of rotation within the plane of the head, or if there is skewed travel of the medium, or the like, then there is little change in the pitch in the formed dots and the occurrence of non-uniformity is suppressed.

Figure 5:
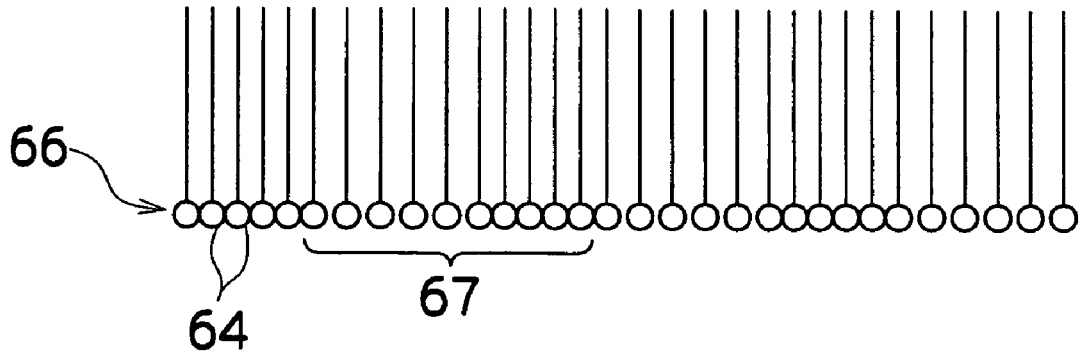
FIG. 5 is an enlarged view of a dot line in the main scanning direction, shown in FIG. 4.

FIG. 5 is an enlarged view of the dot line 66 in the main scanning direction shown in FIG. 4. As clearly revealed by a comparison between the enlarged view of the dot line 66 in the main scanning direction shown in FIG. 5 and the dot line in the main scanning direction in the related art shown in FIG. 19, there is no marked broadening of the distance between the dots and the occurrence of density non-uniformity is restricted according to the present embodiment, compared to the situation in FIG. 19.

The conditions relating to the nozzle arrangement in the liquid ejection head 50 according to the present embodiment are summarized below.

In the liquid ejection head 50 having the nozzles 51 arranged in a two-dimensional configuration, taking L_pitch to be the nozzle distance in the sub-scanning direction on the nozzle surface, between a pair of nozzles that eject droplets to form dots on the print medium that are mutually adjacent in the main scanning direction, and taking L to be the maximum distance between nozzles in the sub-scanning direction, amongst all of the nozzles on the nozzle surface, then the nozzles 51 are arranged under conditions which satisfy the following formula (1):

$$L_\text{pitch}=L\times k/(n-1), \tag{1}$$

where: $k\leqq m+1$; L_pitch is the distance in the sub-scanning direction on the nozzle surface between the nozzles that eject dots that are mutually adjacent on the print medium; m is a number of skipped nozzles in the sub-scanning direction (where m is an integer satisfying the relationship $1\leqq m\leqq n/2$); n is a number of nozzles in the sub-scanning direction (number of rows); k is a positive integer; and L is the maximum distance between the nozzles in the sub-scanning direction.

Here, the "number of skipped nozzles" indicates the number of nozzle constituent elements, such as pressure chambers, located between the pair of nozzles that eject droplets to form dots that are mutually adjacent on the print medium. In the case of FIG. 4, for example, the 8th row nozzle 51-81 and the 10th row nozzle 51-X1 form a pair of nozzles that eject droplets to form dots that are mutually adjacent on the print medium, and one row (m=1) of nozzles (the 9th nozzle row) is located between these nozzles 51-81 and 51-X1, within the distance in the sub-scanning direction between the nozzle pair ($L_\text{pitch}=2\times L_s$). In order to give a general description of this positional relationship, the concept of the parameter "m" is introduced. The "nozzle constituent element" in the case of the present embodiment is the liquid droplet ejection element (ink chamber unit 53) shown in FIG. 3, and is a recording element unit comprising the nozzle 51, the pressure chamber 52, the actuator 58, and the individual electrode 57 of the actuator 58.

Furthermore, the conditions stated in the above-described Formula (1) apply to a case where n≧4. The reason for this is that, when n=3, Formula (1) is written as $$L_\text{pitch}=L\times k/2,$$

where k≦2;

and hence cases may occur where L_pitch has the maximum value L, and the characteristics of the present invention are not displayed. The same applies in cases where n=2 and n=1.

As described above, using the liquid ejection head 50 according to the present embodiment, the density of the banding section is reduced and the perceivability thereof is diminished, in comparison with the print results produced by a type of matrix array head 300 in the related art.

Furthermore, in the above-described embodiment, the pressure chambers 52 corresponding to the nozzles 51 are arranged two-dimensionally in a plane parallel to the nozzle surface 50A, but in implementing the present invention, there are no particular restrictions on the arrangement structure of the pressure chambers corresponding to the nozzles. In other words, in the present invention, it is necessary to adopt the above-described two-dimensional arrangement for the arrangement of the ejection ports (nozzles), but the pressure chambers may also be arranged in a tiered fashion in a direction moving away from the print medium.

Combination with Droplet Ejection Control

By combining the liquid ejection head 50 according to the above-described embodiment with control of droplet ejection (ejection control), it is possible to obtain an enhanced effect in reducing non-uniformity. For example, by regarding a nozzle line arranged in a substantially linear fashion, substantially in line with the sub-scanning direction on the nozzle surface 50A, as one nozzle group, and by implementing the control described below in respect of each nozzle group, it is possible to achieve further reduction of non-uniformity.

More specifically, in the jagged W-shaped nozzle arrangement shown in FIG. 4, the nozzles are divided into groups in units of the nozzle lines corresponding to the respective lines of the jagged W-shaped nozzle arrangement (the substantially straight line sections each having constant directions of inclination with respect to the sub-scanning direction), in such a manner that the nozzles 51-X1, 51-81, 51-61, 51-41 and 51-21 form one group, the nozzles 51-12, 51-32, 51-52, 51-72 and 51-92 form another group, the nozzles 51-X2, 51-82, 51-62, 51-42 and 51-22 form yet another group, and so on.

In FIG. 4, the lines of nozzles are divided into a group in which the lines along the rightward and downward direction (in terms of the row numbers, the nozzle lines from the 1st row→3rd row→5th row→7th row→9th row→10th row), and another group in which the lines along the rightward and downward direction (in terms of the row numbers, the nozzle lines from the 10th row→8th row→6th row→4th row→2nd row→1st row). In this case, the nozzles (the first row nozzle and the tenth row nozzle) at the boundaries between groups may be included in either of the groups.

In other words, the nozzle lines are divided into the two groups such that, when considering any particular nozzle and the next nozzle that ejects the droplet to form the dot adjacent to the dot formed of the droplet ejected by the particular nozzle (in FIG. 4, the adjacent dot to the right-hand side), then one of the two groups is formed of the nozzle lines in which the next nozzle is disposed on the upstream side in the sub-scanning direction with respect to the particular nozzle, and the other of the two groups is formed of the nozzle lines in which the next nozzle is disposed on the downstream side in the sub-scanning direction with respect to the particular nozzle.

In the jagged W-shaped nozzle arrangement in FIG. 4, when considering any particular nozzle ejecting a droplet forming a particular dot and the next nozzle ejecting a droplet forming a dot that makes contact with the particular dot on the right-hand side of the particular dot in the main scanning direction on the print medium, the next nozzle is located on the downstream side in the sub-scanning direction with respect to the particular nozzle, in the lines of nozzles along substantially straight lines in the rightward and downward direction; whereas the next nozzle is located on the upstream side in the sub-scanning direction with respect to the particular nozzle, in the lines of nozzles along in substantially straight lines in the rightward and upward direction.

According to this viewpoint, the nozzle groups are divided into the nozzle groups in which the next nozzle that ejects the droplet forming the next dot in the sequence of a dot line in the main scanning direction is located on the upstream side in the sub-scanning direction on the nozzle surface with respect to the particular nozzle, and the nozzle groups in which the next nozzle is located on the downstream side.

The effects caused by error in the installation angle of the head in a rotational direction within the plane of the head, or tilting of the print medium with respect to the head due to skewed travel or meandering travel of the medium, or relative error in inclination due to a combination of these factors (hereinafter, these errors are referred to generally as "rotational error") are different (opposite), between the group formed by the nozzle lines in the first half of each of the repetition unit of the nozzle lines (each V-shaped arrangement) in the jagged W-shaped nozzle arrangement (namely, the nozzle lines arranged linearly in the rightward and downward direction in FIG. 4), and the group formed by the nozzle lines in the second half of each V-shaped arrangement (namely, the nozzle lines arranged linearly in rightward and downward direction in FIG. 4).

For example, if the head is installed with an angular error due to rotation in the counter-clockwise direction in the plane of the drawing in FIG. 4, then the dot pitch in the main scanning direction increases in the case of the former nozzle line group, whereas the dot pitch in the main scanning direction decreases in the case of the latter nozzle line group. Hence, it is desirable that the nozzles are grouped into blocks based on the lines of nozzles which are affected similarly by rotational error, and the droplet ejection control (density control) is implemented by taking account of the effects caused by rotational error for the groups, respectively.

Embodiments of droplet ejection control include: (1) a mode where the dot size is increased or decreased; (2) a mode where the number of ejected droplets is increased or reduced (by adding dots or thinning out the dots); and the like. The above-described control may be carried out for all of the nozzles in a group, or it may be carried out with respect to a portion of the nozzles extracted (or selected) from the group. Furthermore, provided that the tendency of the whole group (the result after correction) is the desired result (namely, that the tendency of the correction is to increase the recording density or to reduce the recording density, or the like, as required), then some of the nozzles (a portion of the nozzles) in the group may be corrected in the reverse fashion. More specifically, if the nozzles in a group are always corrected in the same direction, then drawbacks (adverse effects) may occur due to extreme correction (excessive correction) in which the effects of the correction operation are in fact more conspicuous than the original non-uniformity, and therefore, from the viewpoint of preventing such drawbacks, it can be seen that suitable correction for the group as a whole may be achieved by correcting a portion of the nozzles of the group in the opposite direction.

Figure 6:
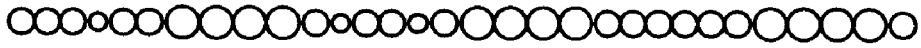
FIG. 6 shows an example of droplet ejection results in a case where control is implemented in order to change the dot sizes in the groups, respectively.

FIG. 6 shows an example of droplet ejection results in a case where control is implemented in order to change the dot sizes in the groups, respectively. As shown in FIG. 6, it is possible to adjust the density so as substantially to remove the density variation between the nozzle groups, by carrying out correction for increasing the dot size in comparison with the reference value in respect of the nozzle groups that have a tendency for the distance between adjacent dots in the main scanning direction to become larger as a result of the rotational error, while conversely, reducing the dot size in comparison with the reference value in respect of the nozzle groups which have a tendency for the distance between adjacent dots in the main scanning direction to become narrower as a result of the rotational error.

Figure 7:
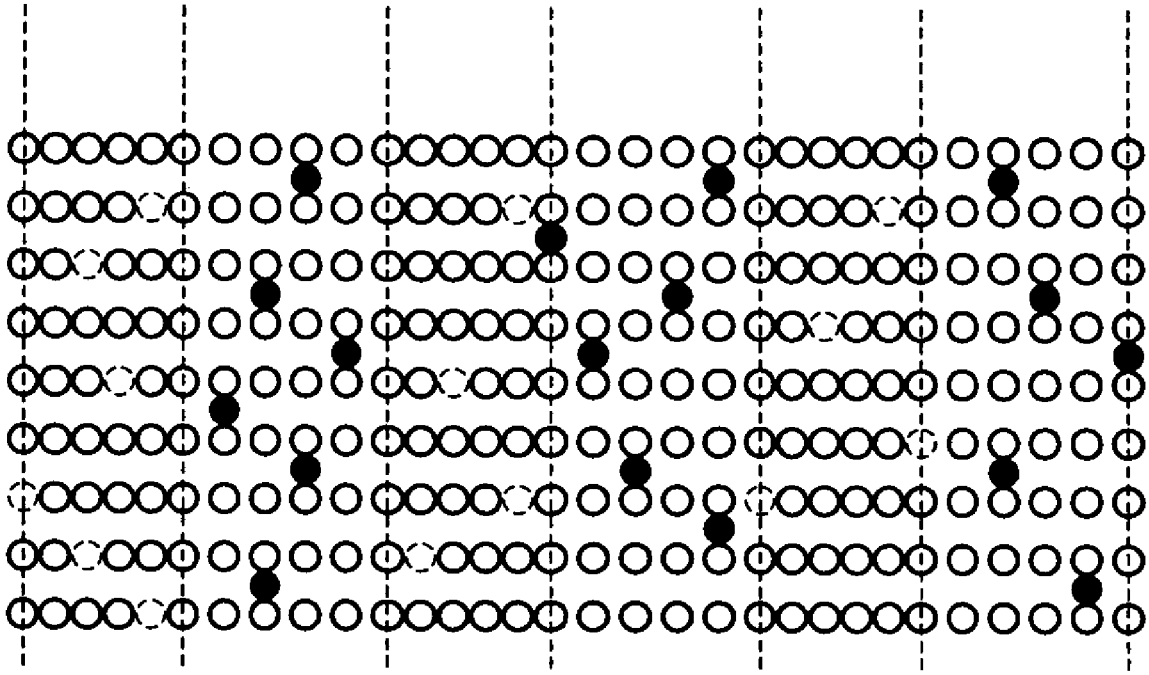
FIG. 7 shows an example of droplet ejection results in a case where control is implemented in order to increase or reduce the numbers of ejected droplets in the groups, respectively.

FIG. 7 shows an example of droplet ejection results in a case where control is implemented in order to increase or decrease the numbers of ejected droplets in the groups, respectively. The divisions marked by the broken lines represent the boundaries between the groups. Furthermore, in FIG. 7, dot positions indicated by dashed circles are thinned-out dots (non-formed dots) for which droplet ejection is canceled, while solid circles (o) are additional dots, which are formed by additionally ejected droplets.

As shown in FIG. 7, the dots are thinned out suitably, thereby reducing the recording density, in the groups corresponding to the sections where the distance between adjacent dots in a dot row aligned in the main scanning direction has become narrower as a result of rotational error. On the other hand, in the case of the groups corresponding to the sections where the distance between adjacent dots becomes larger, the density is increased by ejecting droplets to form additional dots. Thus, the density variation between the groups can be adjusted so that the density is substantially uniform.

When implementing the droplet ejection controls described in FIGS. 6 and 7, desirably, the installation angle of the head 50 in the direction of rotation within the plane of the head, and the amount of skew of the print medium 60 (including the amount of skew due to meandering travel of the medium), are determined, and the amount of correction to be applied in the droplet ejection control procedure is adjusted on the basis of the relative positions of the head and the medium. In other words, in the droplet ejection controls shown in FIGS. 6 and 7, for example, the amount of correction (namely, the amount of correction in the density through change in the dot size, or addition to the number of ejected droplets) is adjusted in accordance with the rotational error that has been determined.

Figure 8B:
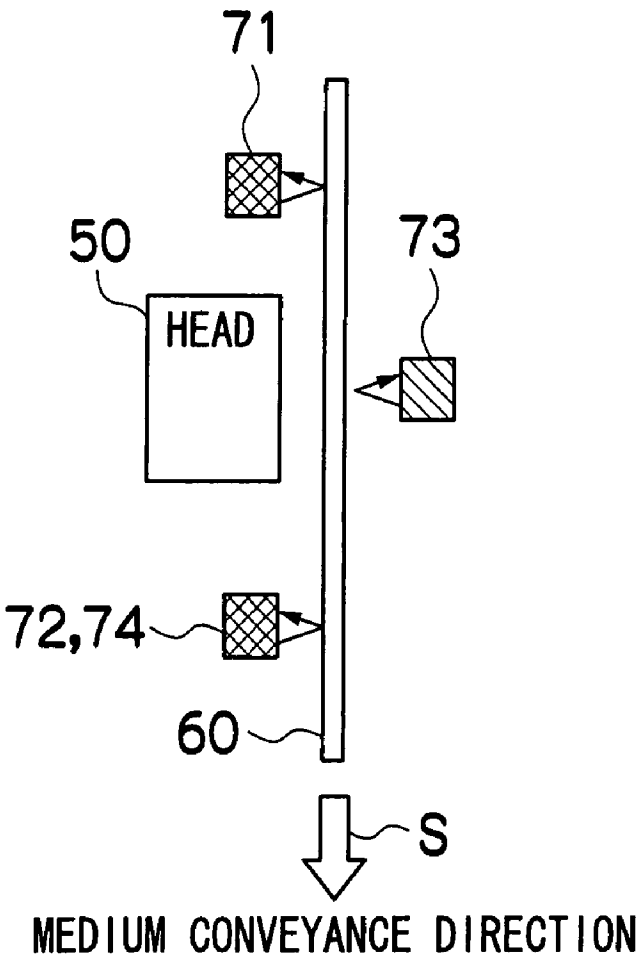
Figure 8A:
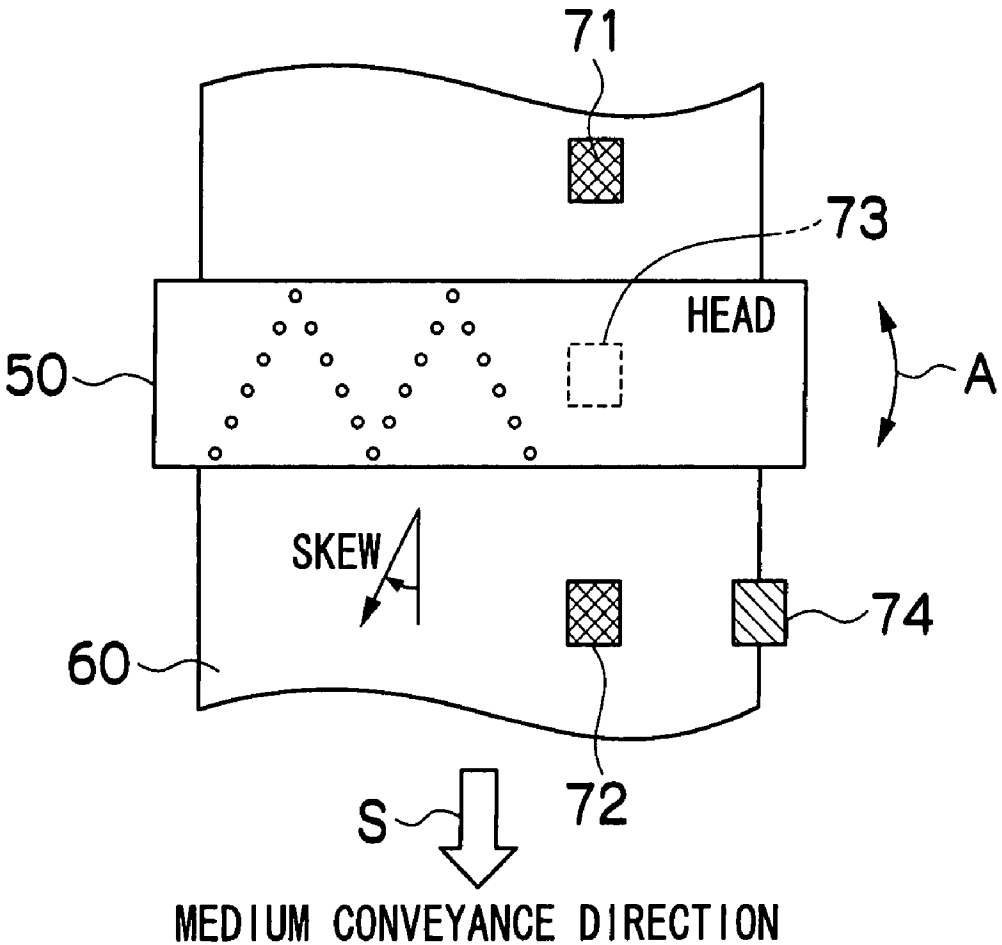

FIGS. 8A and 8B are diagrams showing an embodiment of a device for ascertaining the rotational error, in which FIG. 8A is a plan view and FIG. 8B is a side view.

The inclination of the head 50 in the direction of rotation A within the plane of the head is ascertained by measuring the angle of inclination of the head 50 with respect to the conveyance direction of the print medium 60, by means of a measurement device (not shown), after the head 50 has been installed in the inkjet recording apparatus. The sensor used for this measurement may be a positional sensor having a light source, such as a laser diode (LD) or light-emitting diode (LED), and a photodetector, such as a phototransistor or charge-coupled device (CCD).

Alternatively, the inclination of the head 50 may also be measured by carrying out a reference print (test print) after installing the head, and then analyzing the print medium after printing (the print results).

The information on the error in the installation angle of the head 50 obtained by the above-described measurement is stored in a non-volatile storage device, such as an EEPROM, and by reading out this information according to requirements, the information relating to the installation angle of the head 50 is obtained.

Furthermore, in order to ascertain the amount of skew of the print medium 60, at least one of sensors 71 to 74 for measuring the amount of skew is provided. In the embodiment shown in FIGS. 8A and 8B, the sensors 71 to 73 for measuring the direction of movement of the medium are arranged to face the surface (printing surface or rear surface) of the print medium 60, and the sensor 74 for measuring the direction of movement of the medium is arranged to face the end face of the print medium 60, but in implementing the present invention, it is simply necessary to provide at least one of the sensors. Furthermore, the positions of the sensors are not limited to those shown in the embodiment, and sensors may be located in other suitable positions, such as directly before the head 50 in the sub-scanning direction (on the upstream side of the head), directly after the head 50 in the sub-scanning direction (on the downstream side of the head), or directly below the head 50 on the other side of the print medium 60 from the head 50 (namely, a position opposing the nozzle surface 50A), or the like.

The sensors 71 to 74 measuring the amount of skew may be positional sensors, each having a light source, such as a laser diode (LD) or light-emitting diode (LED), and a photodetector, such as a phototransistor or CCD. For example, each of the sensors 71 to 73 irradiates light onto the surface of the print medium 60 from the light source (light emitting unit), such as an LD, and measures the movement of the surface texture by means of a CCD, or the like, thereby evaluating the amount of skew of the print medium 60.

Figure 9:
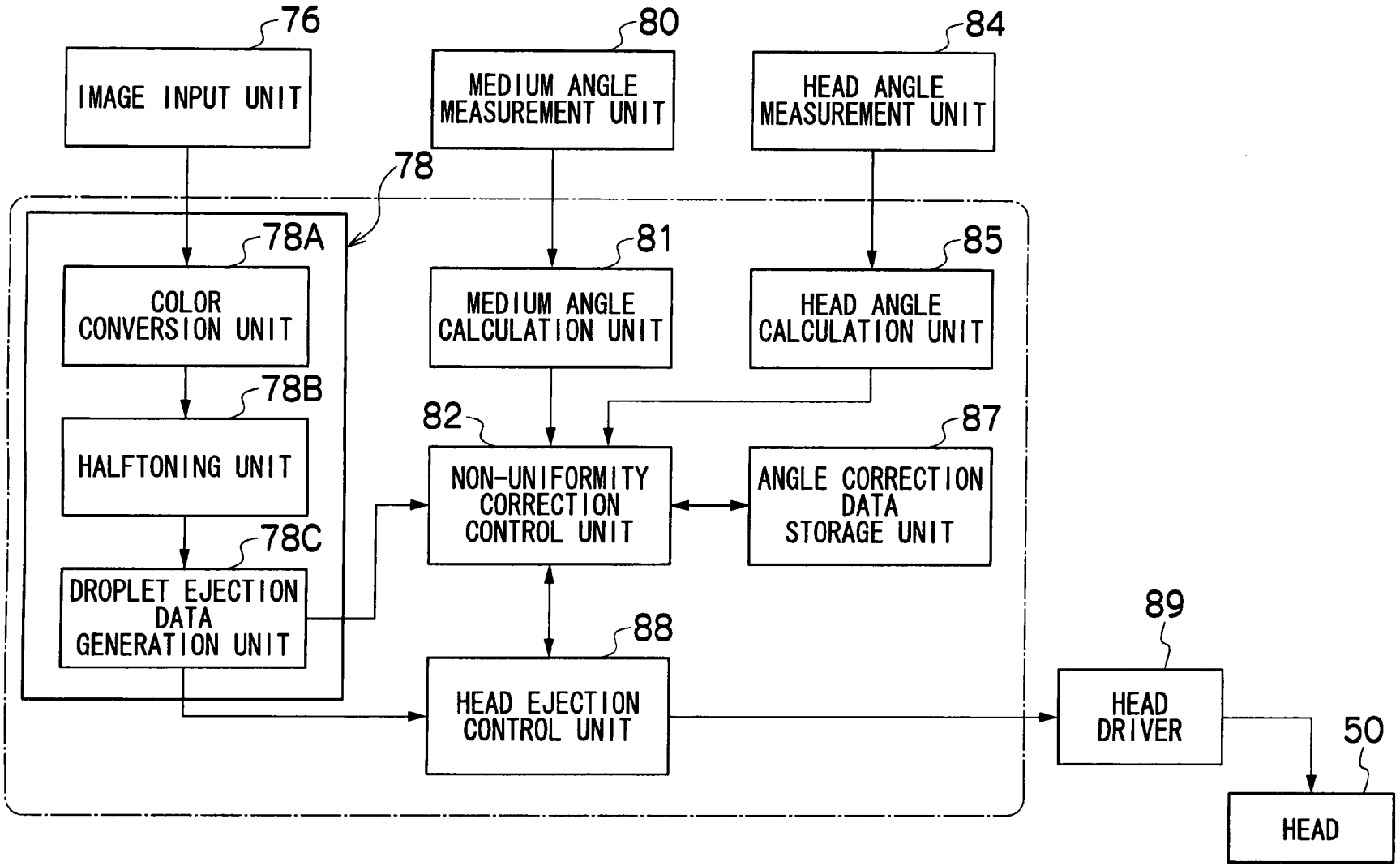
FIG. 9 is a block diagram showing the composition of a control system which controls the driving of the head.

FIG. 9 is a block diagram showing the composition of a control system for controlling the driving of the head 50. An image input unit 76 is a device for inputting image data for printing, and it corresponds to a communication interface, or a media interface for an external storage medium (memory card, optical disk, or the like). The image data inputted through the image input unit 76 is supplied to an image processing unit 78. The image processing unit 78 includes a color conversion unit 78A, a halftoning unit 78B and a droplet ejection data generation unit 78C.

The color conversion unit 78A carries out processing for converting the RGB data of each pixel in the input image data, into KCMY data corresponding to the RGB data. The KCMY data generated by the color conversion unit 78A is subjected to tonal graduation correction, and other processing, and is then supplied to the digital halftoning unit 78B.

The digital halftoning unit 78B is a processing unit for converting the multiple-value KCMY data into image data of fewer tonal graduations (namely, binary dot data, or multiple-value dot data which takes account of changes in the dot size). In the inkjet recording apparatus, an image which appears to have a continuous tonal graduation to the human eye is formed by changing the deposition density and the size of fine dots created by ink (coloring material), and therefore, it is necessary to convert the input digital image into a dot pattern which reproduces the tonal graduations of the image (namely, the light and shade toning of the image) as faithfully as possible. The digital halftoning unit 78B creates dot data for each color, by quantizing the multiple-value data by means of a digital halftoning technique, typically, dithering, error diffusion, a blue noise mask method, or the like.

The resulting data obtained from the digital halftoning unit 78B is supplied to the droplet ejection data generation unit 78C, where it is converted into droplet ejection data for the respective nozzles, which takes account of the nozzle arrangement in the head 50 (namely, the ejection data used to control driving of the ink ejection operation). In this way, droplet ejection data before correction is generated.

A medium angle measurement unit 80 shown in FIG. 9 corresponds to the sensors 71 to 74 shown in FIGS. 8A and 8B and comprises a device for measuring the amount of skew of the print medium 60. The measurement signal obtained from the medium angle measurement unit 80 shown in FIG. 9 is supplied to a medium angle calculation unit 81, and the amount of skew of the print medium 60 (the medium angle) is determined by the medium angle calculation unit 81, on the basis of the measurement signal. The information on the medium angle thus obtained is supplied to a non-uniformity correction control unit 82.

Similarly, an error in the installation angle of the head 50 is determined by a head angle calculation unit 85, on the basis of a signals obtained from a head angle measurement unit 84, and this information is also supplied to the non-uniformity correction control unit 82. The head angle measurement unit 84 may be a sensor provided in the inkjet recording apparatus, or as described with reference to FIGS. 8A and 8B, it may be a measuring device used after installing the head in the manufacturing process, or the like. Alternatively, instead of the head angle measurement unit 84 and the head angle calculation unit 85 shown in FIG. 9, it is also possible to use a storage unit which beforehand stores information relating to the error in the installation angle of the head.

The non-uniformity correction control unit 82 adjusts the amount of correction for the respective nozzles, by referring to a table stored in an angle correction data storage unit 87, on the basis of the information on the medium angle and the information on the head installation angle error thus obtained. The angle correction data storage unit 87 holds data table which associates an amount of correction with the angle of the medium and the head installation angle. Parameters are used to select the amount of correction for each angle. For example, nozzle arrangement data including the nozzle pitch, or correlation coefficients relating to the density and viscosity of the liquid ejected in the form of droplets, may be held in the angle correction data storage unit 87. Since the appearance of non-uniformity is affected by the degree of overlap between the ejected droplets, desirably, a parameter relating to overlap is also taken into account.

In this way, the amount of correction corresponding to the rotational error is determined by the non-uniformity correction control unit 82, and the droplet ejection data is corrected in accordance with this amount of correction. A head ejection control unit, 88 controls a head driver 89 on the basis of the corrected droplet ejection data, thereby controlling the ink ejection operation from the head 50. By means of the above-described composition, the droplet ejection controls described in FIGS. 6 and 7 are achieved. The devices in the region surrounded by the single-dotted line in FIG. 9 may be realized by means of a combination of software and a processor with peripheral circuitry, such as a CPU and memory.

Second Embodiment

Figure 10:
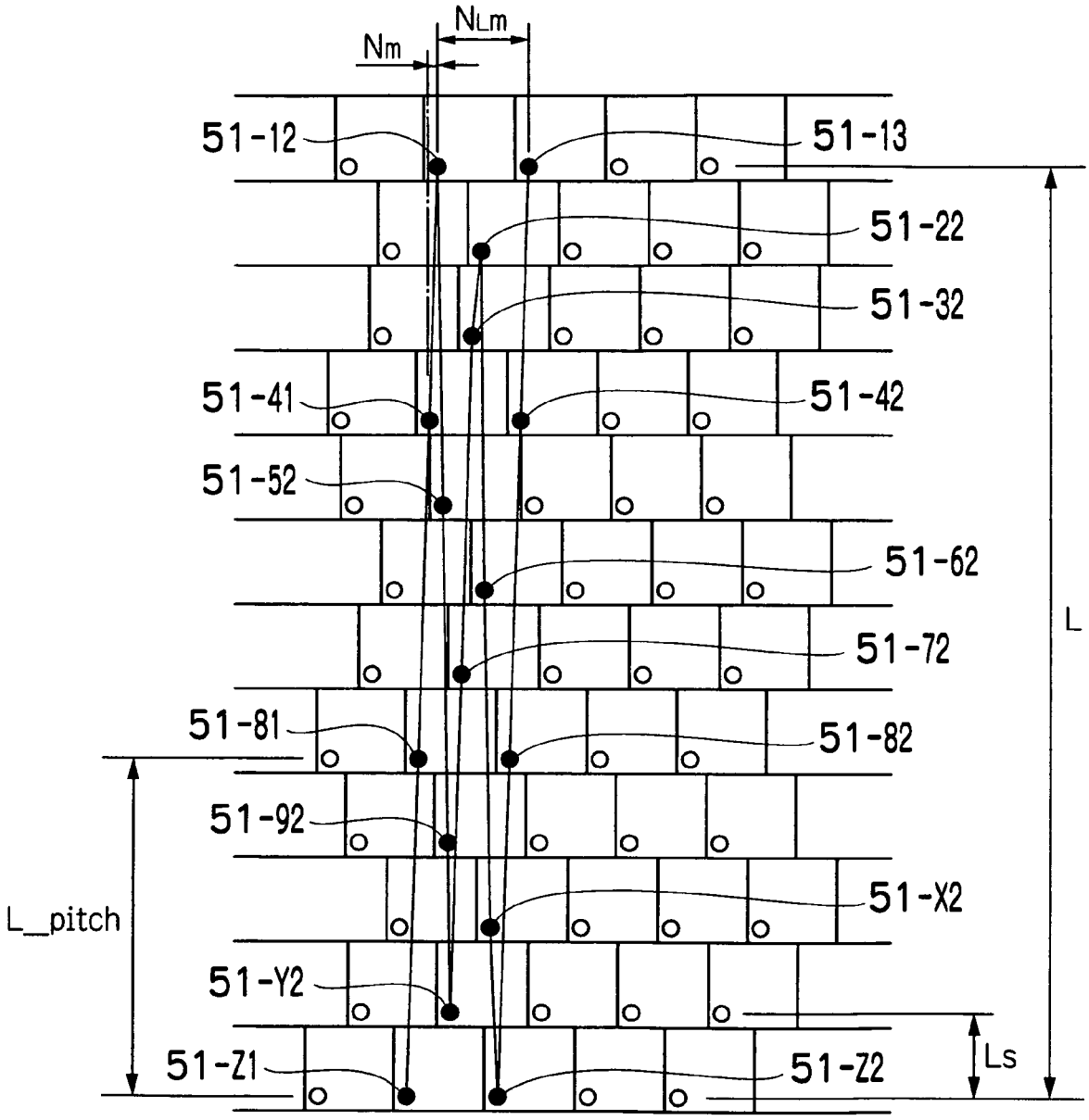
FIG. 10 is an enlarged view showing a schematic drawing of the nozzle arrangement of a liquid ejection head according to a second embodiment of the present invention.

Next, the structure of a liquid ejection head according to a second embodiment of the present invention is described. FIG. 10 is an enlarged view showing a schematic drawing of the nozzle arrangement of the liquid ejection head according to the second embodiment of the present invention. The same method of depiction is used in FIG. 10 as in FIG. 4. However, in FIG. 10, the number of nozzles (number of rows) n in the sub-scanning direction is taken to be twelve. Therefore, in the notification of the nozzle positions, a nozzle in the 11th row (i=11) is indicated as "51-Yj", and a nozzle in the 12th row (i=12) is indicated as "51-Zj".

In FIG. 10, the nozzle pitch $N_{Lm}$ in the main scanning direction is uniform within the rows (the nozzle pitch in the main scanning direction in each row is a constant value of $N_{Lm}$ in all of the nozzles), and the nozzles 51-*ij* of the rows are arranged in a staggered fashion by varying the nozzle positions in the main scanning direction, between the rows. In other words, when the number of nozzle rows in the head 50 (the number of nozzles in the sub-scanning direction) is n (in the case of FIG. 10, n=12), and the effective nozzle pitch in the main scanning direction of the nozzles which eject droplets to form dots that are aligned in the main scanning direction on the print medium is $N_m$, then the relationship $N_{Lm}=n\times N_m$ is satisfied. Furthermore, the distance $L_s$ between the rows in the sub-scanning direction (the column direction in the nozzle arrangement) (in other words, the distance between the nozzles in the sub-scanning direction) is constant, and the maximum distance between the nozzles in the sub-scanning direction is L, where $L=n\times L_s$. These points are similar to the embodiment shown in FIG. 4.

In the embodiment shown in FIG. 10, the nozzle positions in the main scanning direction are shifted between the columns respectively by $N_m$ in the rightward direction in FIG. 10, with respect to the alignment of the nozzles 51-1*j* of the first row, in the sequence: 1st row→5th row→9th row→11th row→7th row→3rd row→2nd row→6th row→10th row→12th row→8th row→4th row, In the nozzle arrangement shown in FIG. 10, the droplet ejection timing from the nozzles 51-*ij* is controlled in synchronism with the conveyance of the print medium, and the nozzles 51-*ij* in the respective rows are driven sequentially in the sequence, 1st row→2nd row→3rd row→ . . . →12th row, thereby causing a single line of dots (main scanning direction dot line) to be printed, in which the dots are arranged linearly in the breadthways direction of the print medium (main scanning direction).

If the nozzle numbers corresponding to the dots are tracked, following the alignment sequence of the dots formed in the main scanning direction dot line, then taking the nozzle 51-12 in FIG. 10 as a starting point, the nozzle sequence is 51-12→51-52→51-92→51-Y2→51-72→51-32→51-22→51-62→51-X2→51-Z2→51-82→51-42→51-13→ . . . .

In this jagged W-shaped nozzle arrangement, the nozzle distance L_pitch in the sub-scanning direction between a pair of nozzles that eject droplets to form dots that are aligned adjacently in the main scanning direction on the print medium has the minimum value of $L_s$, and the maximum value of $4\times L_s$.

In the composition in the related art shown in FIGS. 17 to 19, the nozzle distance in the sub-scanning direction between a pair of nozzles that eject droplets to form dots aligned adjacently in the main scanning direction on the print medium has the minimum value of $L_s$ and the maximum value of $10\times L_s$, and if this is applied to the head having 12 rows, then the maximum value is $12\times L_s$, which means that there is a large difference between the values.

In this respect, according to the embodiment shown in FIG. 10, since there is a small variation (difference between the minimum value and the maximum value) of the nozzle distances in the sub-scanning direction between pairs of nozzles that eject droplets to form dots aligned adjacently in the main scanning direction on the print head, then even if there is an error in the installation position of the head in terms of rotation within the plane of the head, or if there is skewed travel of the medium, or the like, then there is little change in the pitch in the formed dots and the occurrence of non-uniformity is suppressed.

Comparing the composition in FIG. 10 with the embodiment shown in FIG. 4, the composition in FIG. 10 has a larger variation (difference between the maximum value and minimum value) of the nozzle distance in the sub-scanning direction between a pair of nozzles that eject droplets to form dots aligned adjacently in the main scanning direction on the print medium, but the number of turns (juncture regions) within each repetition unit is greater (the spatial frequency of the juncture regions is doubled). By increasing the frequency of the juncture regions of the nozzle columns on the nozzle surface, the perceivability of non-uniformity on the print medium is reduced, and therefore, the non-uniformity can be made less conspicuous while also restricting the amount of variation in the nozzle distances in the sub-scanning direction between pairs of nozzles that eject droplets to form adjacent dots in the main scanning direction.

Figure 11:
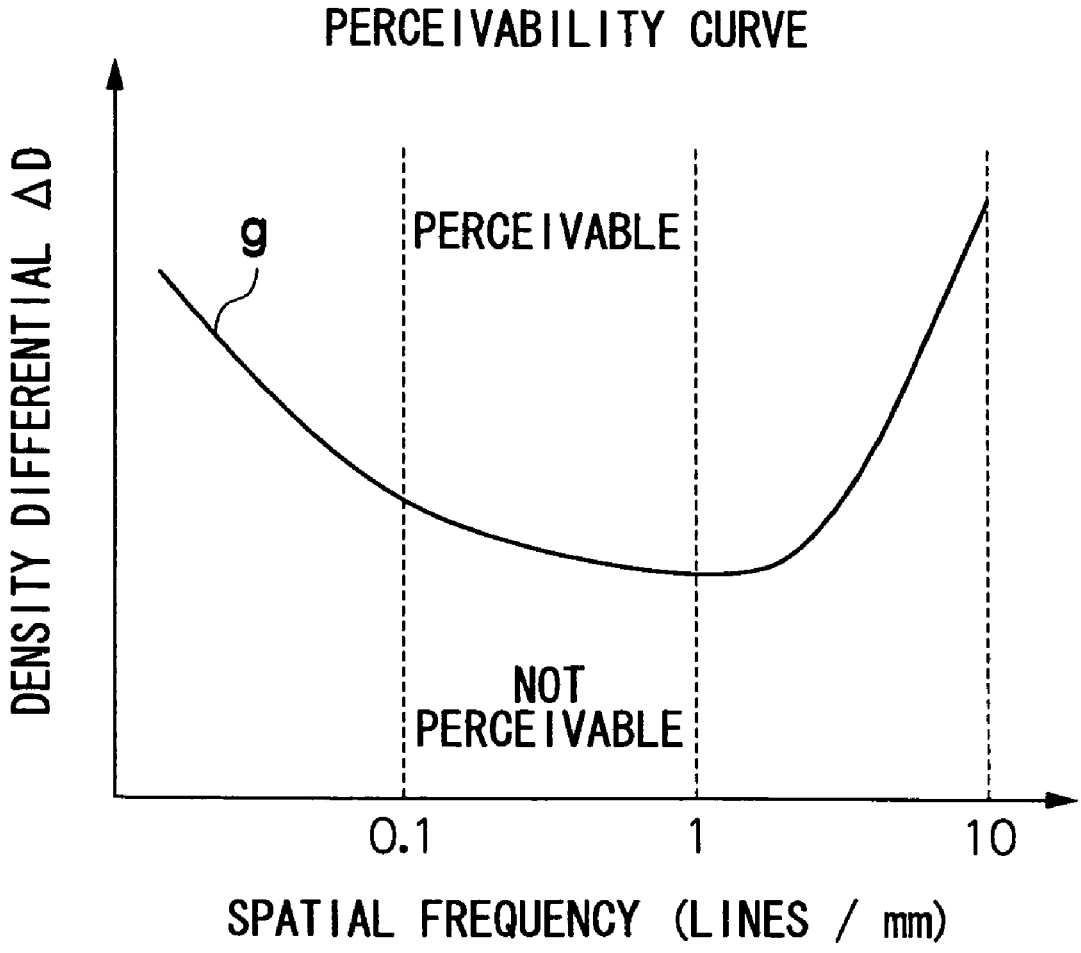
FIG. 11 is a graph of a perceivability curve indicating the relationship between the repetition frequency of the band-shaped non-uniformity (spatial frequency), and the density differential $\Delta D$ that is perceived as non-uniformity.

FIG. 11 is a graph of a perceivability curve indicating the relationship between the repetition frequency (spatial frequency) of the band-shaped non-uniformity, and the density differential $\Delta D$ that is perceived as non-uniformity. The horizontal axis in FIG. 11 represents the repetition frequency (spatial frequency) of the non-uniformity (unit: lines/mm) on a logarithmic scale, and the vertical axis in FIG. 11 represents the density differential that is perceptible.

In the region below the perceivability curve g, non-uniformity is not perceptible, whereas in the region above the perceivability curve g, a non-uniformity is perceptible.

As shown in FIG. 11, when the spatial frequency of the non-uniformity has a high frequency (desirably, 3 lines/mm or above, and more desirably, 4 lines/mm or above), then the non-uniformity is not readily perceivable.

The positions at which banding occurs on the print medium 60 correspond to the positions of the juncture regions (singular positions) of the nozzle columns on the nozzle surface 50A, and hence the perceivability of the non-uniformity can be reduced by increasing the frequency of the juncture regions of the nozzles columns, to 3 or more lines/mm, which is not readily perceivable to observers.

In the matrix arrangement in the related art described in FIG. 17, supposing that 48 rows of nozzles are arranged in the sub-scanning direction on the nozzle surface in the nozzle density of 2400 nozzles per inch (npi) corresponding to the nozzle pitch of about 10 μm, in order to achieve a recording resolution in the main scanning direction of 2400 dpi, then the pitch of the juncture regions of the nozzle columns is 10 (μm)×48 (nozzles)≈0.5 mm, and the spatial frequency of the banding non-uniformity is 2 lines/mm, which is readily perceivable.

On the other hand, in the case of the jagged W-shaped nozzle arrangement shown in FIG. 4, the spatial frequency of the banding non-uniformity under the same conditions (2400 dpi and 48 rows) is 4 lines/mm, and in the case of the jagged W-shaped nozzle arrangement having double the frequency as shown in FIG. 10, the spatial frequency of the banding non-uniformity under the same conditions (2400 dpi and 48 rows) is 8 lines/mm. Therefore, the perceivability of non-uniformity is reduced in comparison with the related art, from the viewpoint of the perceivability curve shown in FIG. 11, also.

In the nozzle arrangement shown in FIG. 10, similarly to the embodiment described with reference to FIGS. 1 to 9, further reduction in non-uniformity can be obtained by controlling droplet ejection (controlling density) in each nozzle group, respectively.

Figure 12:
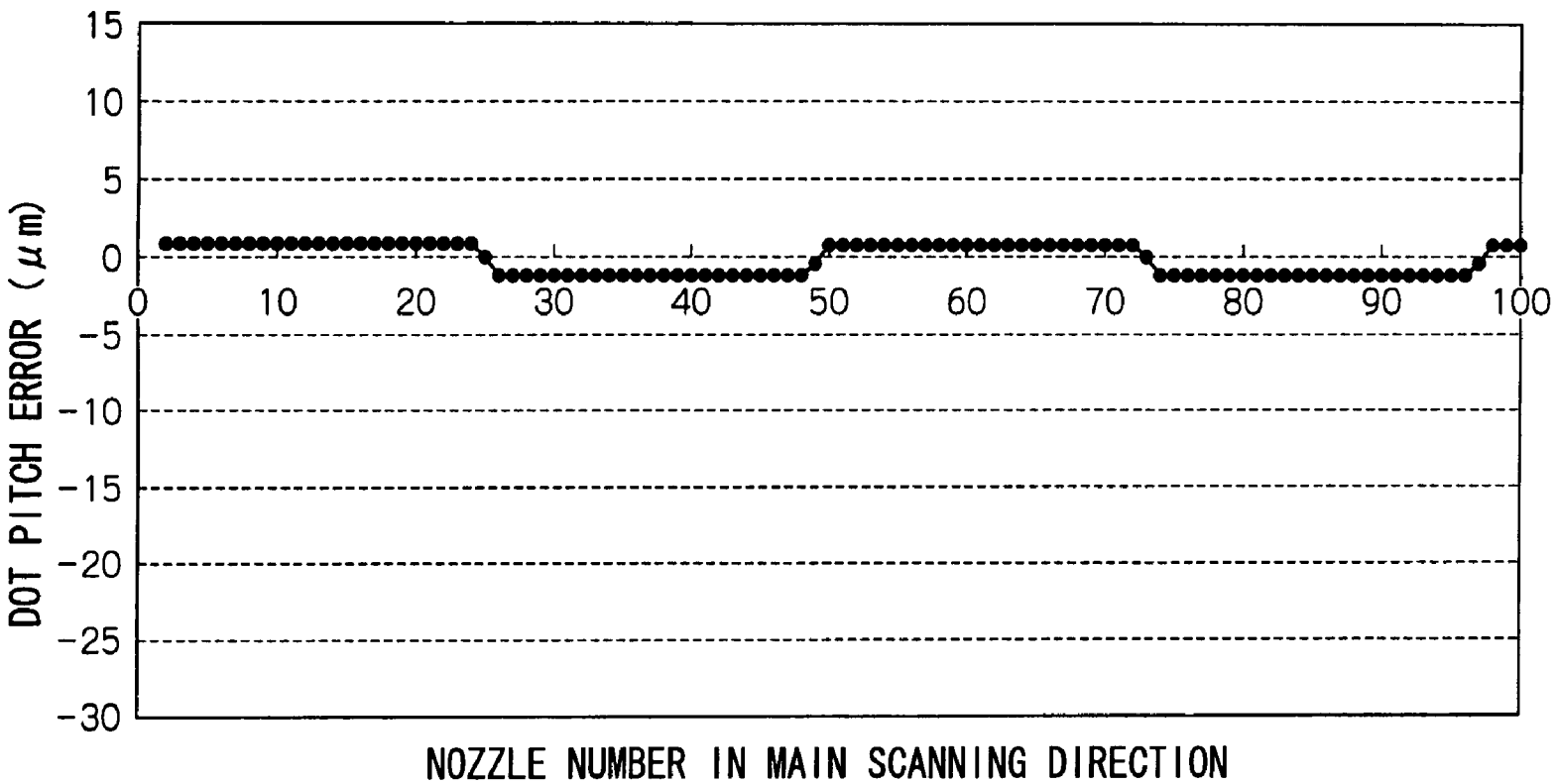
FIG. 12 is a graph showing the relationship between the nozzle positions and the dot pitch error in the main scanning direction, for a composition according to the first embodiment.
Figure 13:
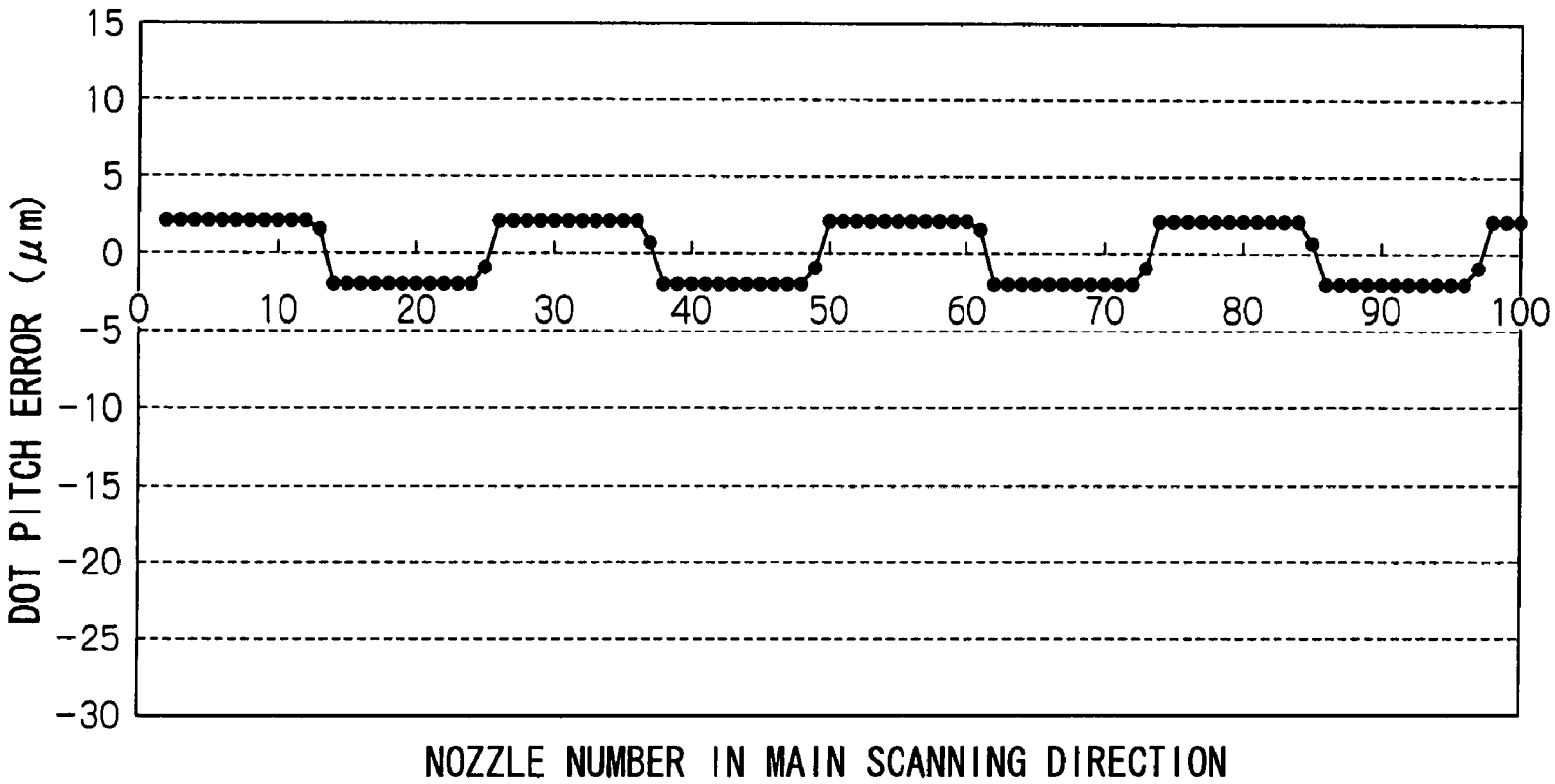
FIG. 13 is a graph showing the relationship between the nozzle positions and the dot pitch error in the main scanning direction, for a composition according to the second embodiment.
Figure 14:
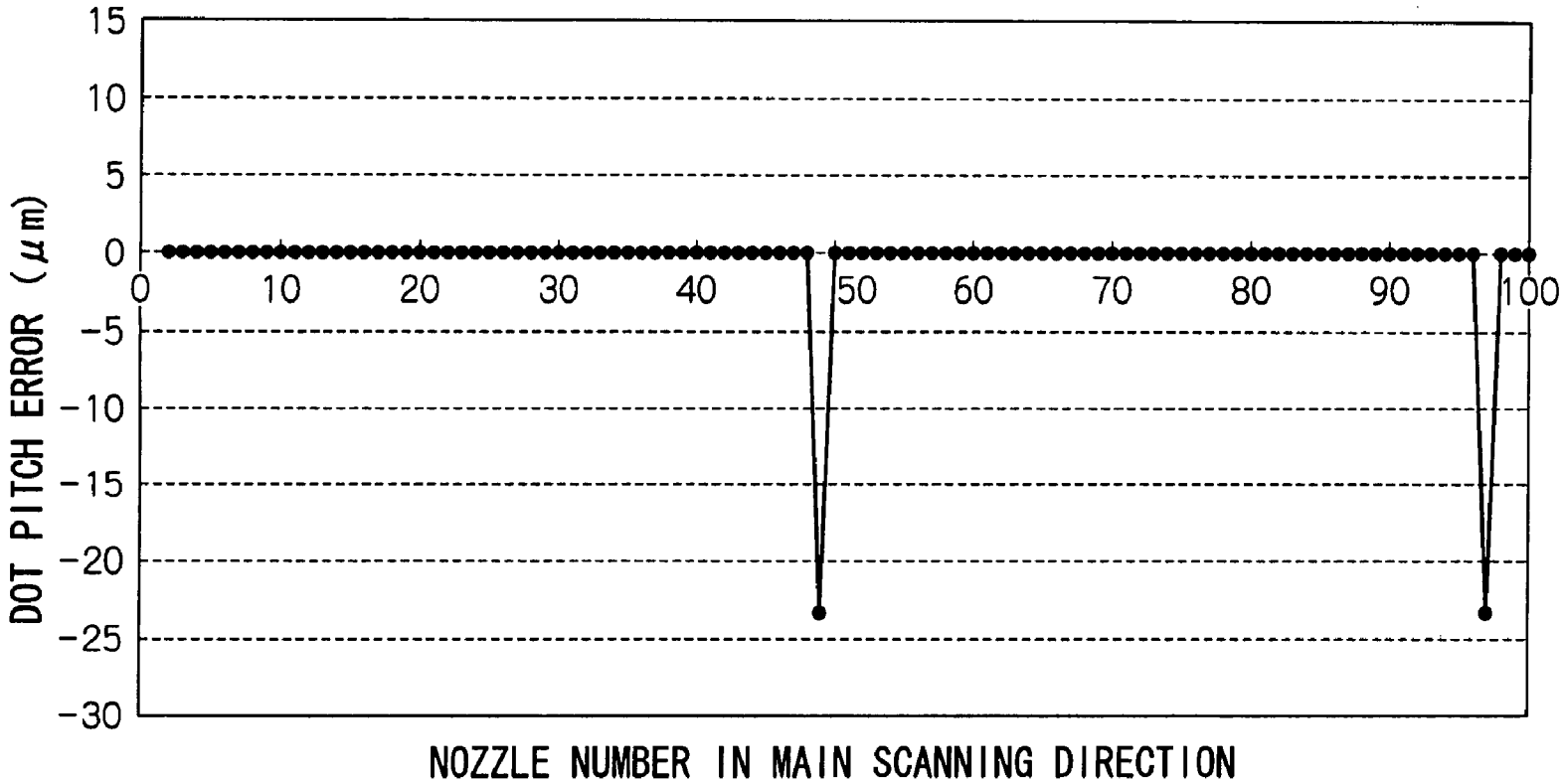
FIG. 14 is a graph showing the relationship between the nozzle positions and the dot pitch error in the main scanning direction, for a composition in the related art.

In order to compare the characteristics of the above-described three types of nozzle arrangement, namely, the composition of the first embodiment shown in FIGS. 1 to 4, the composition of the second embodiment shown in FIG. 10, and the composition in the related art shown in FIGS. 17 to 19, graphs depicting the pitch error in the dots that are adjacent in the main scanning direction on the print medium, under the same conditions (2400 dpi, 48 rows in the sub-scanning direction, and rotational error of β), are shown in FIGS. 12 to 14. The rotational error β is caused by installing the head 50 at an angle of β in the clockwise direction, with respect to the correct installation position, within the plane of the drawing in FIG. 1.

FIG. 12 shows a graph for a composition according to the first embodiment, FIG. 13 shows a graph for a composition according to the second embodiment, and FIG. 14 shows a graph for a composition in the related art. In these diagrams, the horizontal axis indicates the nozzle number in the main scanning direction, and the vertical axis indicates the pitch error in the adjacent dots in the main scanning direction. In each of these nozzle arrangements, the nozzle pitch $N_{Lm}$ in the main scanning direction within each row is 480 μm, the effective nozzle pitch $N_m$ in the main scanning direction of the nozzles that eject droplets to form dots aligned in the main scanning direction on the print medium is 10 μm, and the nozzle pitch $L_s$ in the sub-scanning direction is 500 μm.

In the diagrams, the positive direction of the vertical axis represents an increase in the pitch between the adjacent dots, and the greater this value, the lower the density of the print result. Conversely, the negative direction of the vertical axis represents a decrease in the pitch between the adjacent dots, and the smaller this value, the higher the density of the print result.

As shown in FIG. 12, according to the composition of the first embodiment, the sign of the dot pitch error is reversed at the positions corresponding to the juncture regions of the nozzle columns, and the absolute value of the dot pitch error is kept to an extremely small value. In other words, it is possible to ensure that the band-shaped difference in density occurring at the positions corresponding to the juncture regions is very small, and therefore, the occurrence of density non-uniformities is suppressed.

As shown in FIG. 13, according to the composition of the second embodiment, similarly to the graph in FIG. 12, the sign of the dot pitch error is reversed at the positions corresponding to the juncture regions of the nozzle columns, and the interval between these positions is shorter (the spatial frequency is greater) than the case of the first embodiment. This is because the number of juncture regions of the nozzle columns is increased. Furthermore, compared to the graph in FIG. 12, the absolute value of the dot pitch error is larger, but as stated previously, this is not readily perceivable as a non-uniformity in density, as indicated by the perceivability curve.

As shown in FIG. 14, according to the composition of the related art, the dot pitch error changes suddenly at the positions corresponding to the juncture regions of the nozzles columns, and the absolute value of the dot pitch error in these positions is very large. Therefore, the difference in density with respect to the adjacent regions is large, and non-uniformity is readily perceivable.

Composition of Inkjet Recording Apparatus

Next, the composition of an inkjet recording apparatus which uses the liquid ejection head described in the first and second embodiments is explained.

Figure 15:
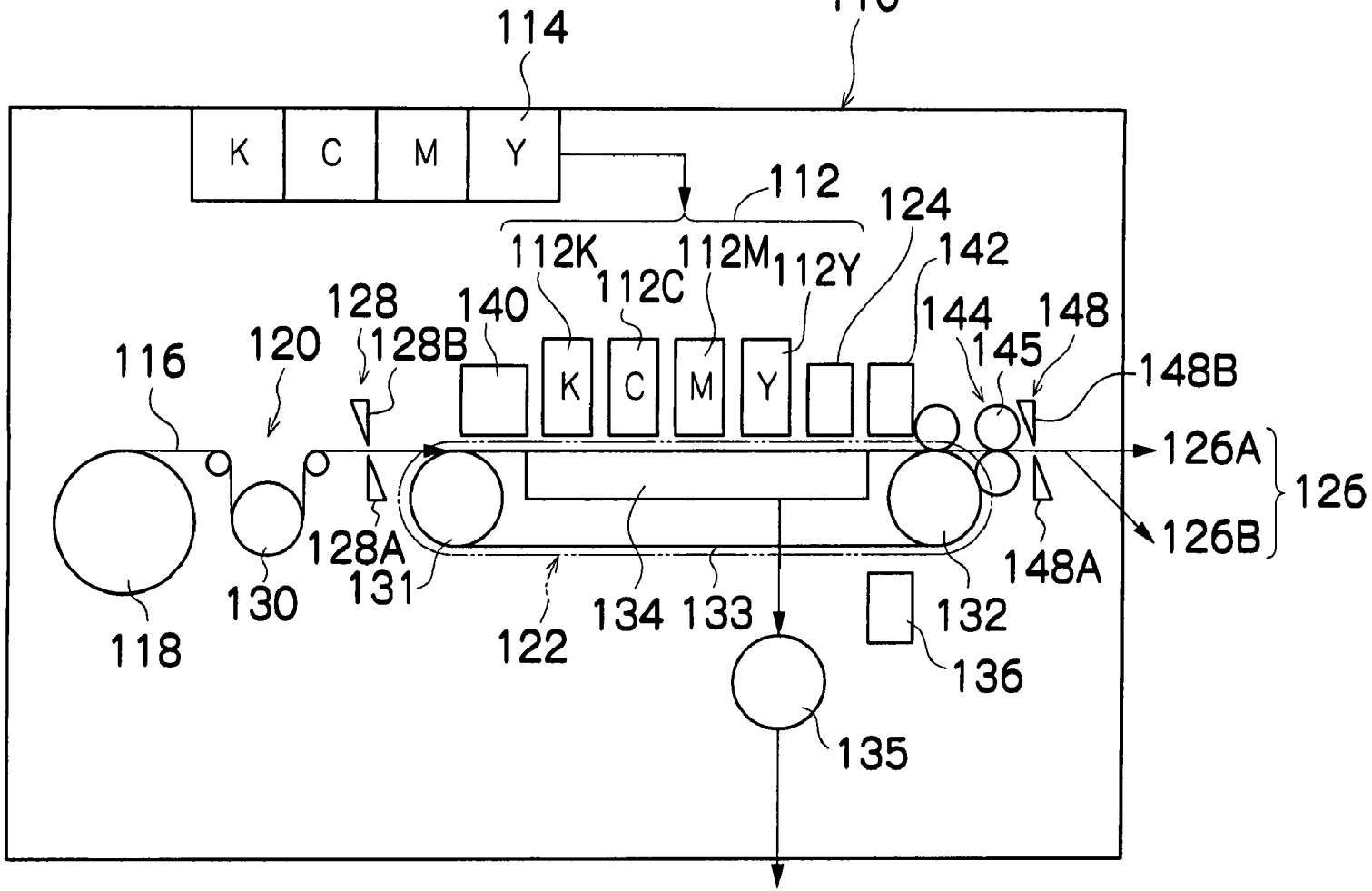
FIG. 15 is a general schematic drawing of an inkjet recording apparatus which forms an image forming apparatus according to an embodiment of the present invention.

FIG. 15 is a general configuration diagram of an inkjet recording apparatus showing an image forming apparatus according to an embodiment of the present invention. As shown in FIG. 15, the inkjet recording apparatus 110 comprises: a printing unit 112 having a plurality of inkjet recording heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The liquid ejection head 50 according to the first or second embodiment is used respectively for the heads 112K, 112C, 112M and 112Y of the print unit 112.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 15, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (a first cutter) 128 is provided as shown in FIG. 15, and the roll paper is cut to a desired size by the cutter 128. The cutter 28 has a stationary blade 128A, whose length is not less than the width of the conveyor pathway of the recording paper 116, and a round blade 128B, which moves along the stationary blade 128A. The stationary blade 128A is disposed on the reverse side of the printed surface of the recording paper 116, and the round blade 128B is disposed on the printed surface side across the conveyance path. When cut paper is used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 15. The suction chamber 134 provides suction with a fan 135 to generate a negative pressure, and the recording paper 116 is held on the belt 133 by suction. In place of the suction system, the electrostatic attraction system can be employed.

The belt 133 is driven in the clockwise direction in FIG. 15 by the motive force of a motor 188 (shown in FIG. 16) being transmitted to at least one of the rollers 131 and 132, which the belt 133 is set around, and the recording paper 116 held on the belt 133 is conveyed from left to right in FIG. 15.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus 110 can comprise a roller nip conveyance mechanism, in which the recording paper 116 is pinched and conveyed with nip rollers, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 1).

In FIG. 15, the print heads 112K, 112C, 112M and 112Y are arranged in color order of black (K), cyan (C), magenta (M) and yellow (Y) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 15 has an image sensor (line sensor or area sensor) for capturing an image of the droplet ejection result of the print unit 112, and functions as a device to check for ejection defects such as blockages, landing position displacement, and the like, of the nozzles, on the basis of the image of ejected droplets read in by the image sensor. Furthermore, it is also possible to measure rotational errors in the installation of the heads, by means of this print determination unit 124.

A test pattern or the target image printed by the print heads 112K, 112C, 112M, and 112Y of the respective colors is read in by the print determination unit 124, and the ejection performed by each head is determined. The ejection determination includes detection of the ejection, measurement of the dot size, and measurement of the dot formation position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed object generated in this manner is output through the paper output unit 126. Desirably, the actual image that is to be printed (the printed copy of the desired image), and test prints, are output separately. In the inkjet recording apparatus 110, a sorting device (not shown) is provided for switching the outputting pathway in order to sort the printed matter with the target print and the printed matter with the test print, and to send them to paper output units 126A and 126B, respectively. If the main image and the test print are formed simultaneously in a parallel fashion, on a large piece of printing paper, then the portion corresponding to the test print is cut off by means of a cutter (second cutter) 148. The second cutter 148 is disposed directly in front of the paper output unit 126, and is used for cutting the test print portion from the target print portion when a test print has been performed in the blank portion of the target print. The structure of the cutter 148 is the same as the first cutter 128 described above, and has a stationary blade 148A and a round blade 148B. Although not shown in FIG. 15, the paper output unit 126A for the target prints is provided with a sorter for collecting prints according to print orders.

Description of Control System

Figure 16:
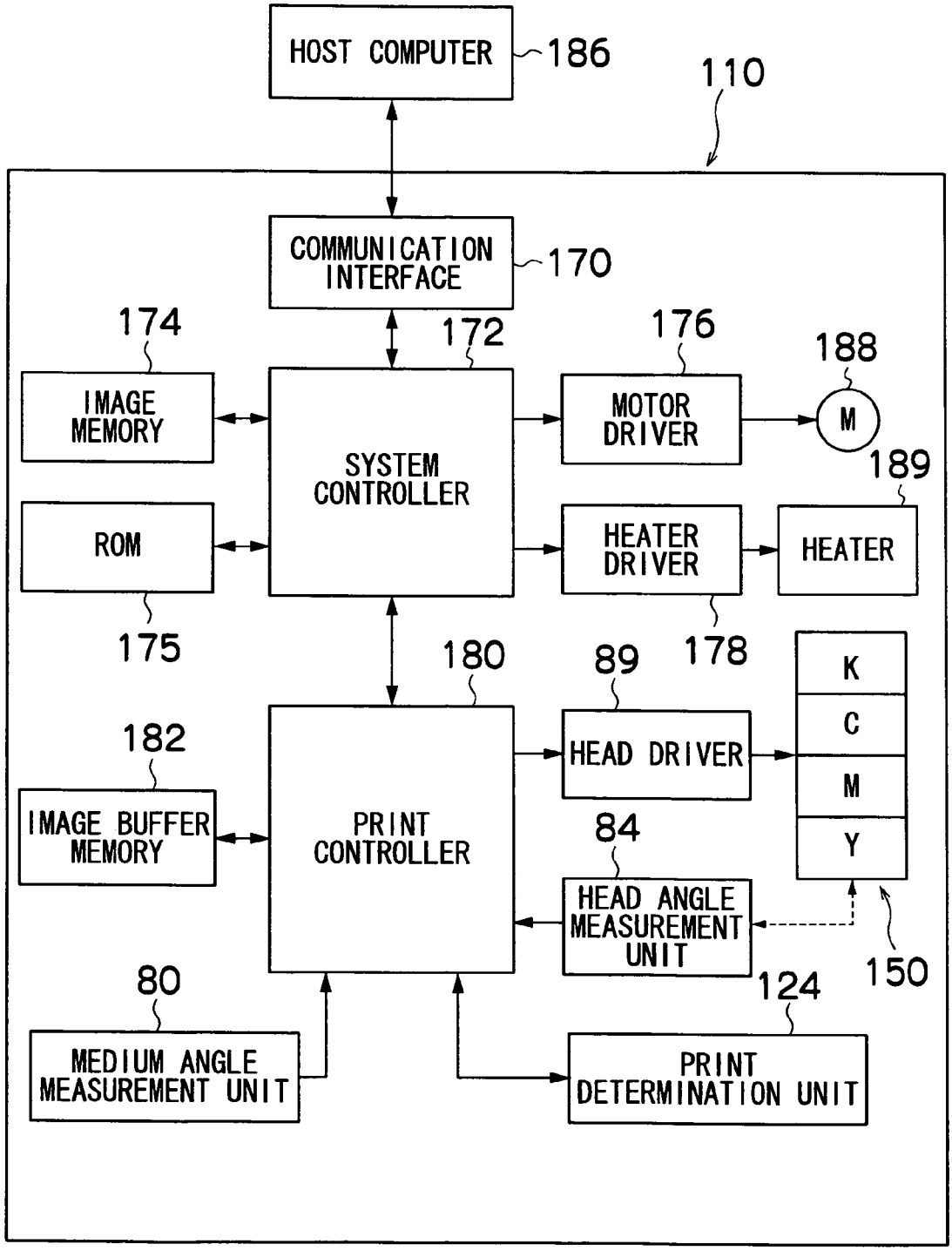
FIG. 16 is a block diagram showing the system configuration of the inkjet recording apparatus shown in FIG. 15.

FIG. 16 is a block diagram showing the system composition of the inkjet recording apparatus 110. As shown in FIG. 16, the inkjet recording apparatus 110 comprises a communication interface 170, a system controller 172, an image memory 174, a ROM 175, a motor driver 176, a heater driver 178, a print controller 180, an image buffer memory 182, the head driver 89, and the like. In FIG. 16, in order to simplify the illustration, the heads of the respective colors are represented by the reference numeral 150.

The communication interface 170 is an interface unit for receiving image data transmitted by a host computer 186. For the communication interface 170, a serial interface, such as USB, IEEE 1394, the Internet, or a wireless network, or the like, or a parallel interface, such as a Centronics interface, or the like, can be used. It is also possible to install a buffer memory (not shown) for achieving high-speed communications. This communication interface 170 corresponds to the image input unit 76 shown in FIG. 9.

As shown in FIG. 16, the image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system.

The program executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of conveyance system in accordance with commands from the system controller 172. The heater driver (drive circuit) 178 drives the heater 189 of the post-drying unit 142 or the like in accordance with commands from the system controller 172.

The print controller 180 has a signal processing function for performing various tasks, compensations, and other types of processing for generating print control signals from the image data (original data) stored in the image memory 174 in accordance with commands from the system controller 172 so as to supply the generated dot data (droplet ejection data) to the head driver 89.

The image buffer memory 182 is provided in the print controller 180, and image data, parameters, and other data are temporarily stored in the image buffer memory 182 when image data is processed in the print controller 180. FIG. 16 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is inputted from an external source through the communication interface 170, and is accumulated in the image memory 174. At this stage, RGB image data is stored in the image memory 174, for example.

Original image data (RGB data) stored in the image memory 174 is sent to the print controller 180 through the system controller 172, and is converted into dot data for each ink color by means of color conversion and halftoning processes in the print controller 180.

In other words, the print controller 180 performs processing for converting the input RGB image data into dot data for the four colors of K, C, M and Y. The dot data generated by the print controller 180 in this way is stored in the image buffer memory 182.

As described above with reference to FIG. 9, the head driver 89 outputs drive signals for driving the actuators 58 corresponding to the respective nozzles 51 of the print head 150, on the basis of the droplet ejection data supplied by the print controller 180 in FIG. 16 (in other words, the dot data stored in the image buffer memory 182). A feedback control system for maintaining constant drive conditions in the head may be included in the head driver 89.

By supplying the drive signals outputted by the head driver 89 to the print head 150, ink is ejected from the corresponding nozzles 51. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled through the head driver 89, on the basis of the dot data generated by implementing prescribed signal processing in the print controller 180. By this means, prescribed dot size and dot positions can be achieved.

In addition, the inkjet recording apparatus 110 according to the present embodiment has the medium angle measurement unit 80 and the head angle measurement unit 84. The functions of the medium angle measurement unit 80 and the head angle measurement unit 84 are described above with reference to FIG. 9. The information obtained from these measurement units is supplied to the print controller 180, and it is used to control droplet ejection from the respective nozzles (namely, to control the ejection state).

In other words, the system controller 172 or the print controller 180 shown in FIG. 16, or a composition combining these, performs the functions of the image processing unit 78, the medium angle calculation unit 81, the non-uniformity correction control unit 82, the head angle calculation unit 85, the angle correction data storage unit 87 and the head ejection control unit 88 shown in FIG. 9.

As described above with reference to FIG. 15, the print determination unit 124 is a block including an image sensor, which reads in the image printed on the recording paper 116, performs various signal processing operations, and the like, and determines the print situation (presence/absence of ejection, variation in droplet ejection, optical density, and the like), these determination results being supplied to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside, or in the vicinity of, each pressure chamber of the print head 150, and ejection abnormalities are determined from the determination signals obtained from these pressure sensors when ink is ejected or when the actuators are driven in order to measure the pressure. Alternatively, it is also possible to adopt a mode (external determination method) using an optical determination system comprising a light source, such as a laser light emitting element, and a photoreceptor element, whereby light, such as laser light, is irradiated onto the ink droplets ejected from the nozzles and the droplets in flight are determined by means of the transmitted light quantity (received light quantity).

The print controller 180 implements various corrections with respect to the head 150, on the basis of the information obtained from the print determination unit 124 or another ejection determination device (not shown), according to requirements, and it implements control for carrying out cleaning operations (nozzle restoring operations), such as preliminary ejection, suctioning, or wiping, as and when necessary.

According to the inkjet recording apparatus 110 having the above-described composition, the occurrence of non-uniformity is suppressed and satisfactory image formation becomes possible.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head comprising a nozzle surface in which a plurality of nozzles for ejecting droplets of liquid toward an ejection receiving medium are arranged two-dimensionally in conditions satisfying the following relationships:

$$L_\text{pitch}=L\times k/(n-1),$$

where:

$k \leqq m+1$;

L_pitch is a distance in a first direction on the nozzle surface between a pair of the nozzles that eject the droplets to form dots that are aligned adjacently in a second direction on the ejection receiving medium, the first direction being a direction in which the ejection receiving medium is moved relatively with respect to the liquid ejection head, the second direction being substantially perpendicular to the first direction;

L is a maximum distance between the nozzles in the first direction on the nozzle surface;

n is a number of the nozzles in the first direction on the nozzle surface, and is an integer not less than 4;

m is a number of skipped nozzles indicating a number of nozzles disposed in the first direction within the distance L_pitch between the pair of the nozzles in the first direction and is an integer satisfying $1 \leqq m \leqq n/2$; and k is a positive integer.

2. A liquid ejection apparatus, comprising:

the liquid ejection head as defined in claim 1;

a conveyance device which produces a relative movement of the ejection receiving medium in the first direction with respect to the liquid ejection head, by conveying at least one of the liquid ejection head and the ejection receiving medium; and an ejection control device which implements control in order to eject the droplets of the liquid from the nozzles of the liquid ejection head, in accordance with the relative movement produced by the conveyance device.

3. The liquid ejection apparatus as defined in claim 2, further comprising an ejection correction device which:

when forming a second direction dot line of dots aligned in the second direction on the ejection receiving medium by depositing the droplets ejected from the nozzles onto the ejection receiving medium, while moving the ejection receiving medium relatively with respect to the liquid ejection head in the first direction by the conveyance device, and when the nozzles in the nozzle surface which correspond to the dots are tracked following an alignment sequence of the dots that are mutually adjacent in the second direction in the second direction dot line, then divides the nozzles into a nozzle group in which the nozzle which ejects the droplet forming a next dot in the alignment sequence is positioned on an upstream side in terms of the first direction, and a nozzle group in which the nozzle which ejects the droplet forming the next dot in the alignment sequence is positioned on a downstream side in terms of the first direction, and corrects an ejection state for each of the nozzle groups.

4. The liquid ejection apparatus as defined in claim 3, further comprising:

a head angle determination device which determines an installation angle of the liquid ejection head; and a correction amount control device which controls an amount of correction for correcting the ejection state, according to a determination result of the head angle determination device.

5. The liquid ejection apparatus as defined in claim 3, further comprising:

a medium angle determination device which determines an angle of conveyance direction of the ejection receiving medium by the relative movement with respect to the liquid ejection head; and a correction amount control device which controls an amount of correction for correcting the ejection state, according to a determination result of the medium angle determination device.

6. An image forming apparatus, comprising the liquid ejection apparatus as defined in claim 2, and forming an image on the ejection receiving medium by means of ink liquid ejected from the nozzles.

7. A liquid ejection head comprising a nozzle surface in which a plurality of nozzles for ejecting droplets of liquid toward an ejection receiving medium are arranged two-dimensionally, wherein:

a first direction is a direction in which the ejection receiving medium is moved relatively with respect to the liquid ejection head, and a second direction being substantially perpendicular to the first direction;

second direction nozzle rows constituted by the nozzles arranged linearly on the nozzle surface in the second direction are formed in n rows at mutually different positions on the nozzle surface in terms of the first direction, where n is an integer not less than 4;

m rows of the second direction nozzle rows are disposed within a distance in the first direction on the nozzle surface between a pair of the nozzles that eject the droplets to form dots that are aligned adjacently in the second direction on the ejection receiving medium, where m is an integer satisfying $1 \leqq m \leqq n/2$;

the liquid ejection head is capable of forming a second direction dot line of dots aligned in the second direction on the ejection receiving medium by depositing the droplets ejected from the nozzles in each of the n rows onto the ejection receiving medium, while moving the ejection receiving medium relatively with respect to the liquid ejection head in the first direction; and a jagged line nozzle arrangement is adopted, in which, when the nozzles in the nozzle surface which correspond to the dots are tracked following an alignment sequence of the dots that are mutually adjacent in the second direction in respect of a continuous group of n dots formed of the droplets ejected from the nozzles in each of the n rows in the second direction dot line, then nozzle lines comprising nozzle groups in which the nozzle which ejects the droplet forming a next dot in the alignment sequence is positioned on an upstream side in terms of the first direction, and nozzle lines comprising nozzle groups in which the nozzle which ejects the droplet forming the next dot in the alignment sequence is positioned on a downstream side in terms of the first direction, are combined together in a form of a jagged line.

8. The liquid ejection head as defined in claim 7, wherein the plurality of nozzles are arranged two-dimensionally in conditions satisfying the following relationships:

$$L_pitch = L \times k/(n-1),$$

where:

$k \leqq m+1$;

L_pitch is the distance in the first direction on the nozzle surface between the pair of the nozzles that eject the droplets to form the dots that are aligned adjacently in the second direction on the ejection receiving medium;

L is a maximum distance between the nozzles in the first direction on the nozzle surface; and k is a positive integer.

9. A liquid ejection apparatus, comprising:

the liquid ejection head as defined in claim 7;

a conveyance device which produces a relative movement of the ejection receiving medium in the first direction with respect to the liquid ejection head, by conveying at least one of the liquid ejection head and the ejection receiving medium; and an ejection control device which implements control in order to eject the droplets of the liquid from the nozzles of the liquid ejection head, in accordance with the relative movement produced by the conveyance device.

10. The liquid ejection apparatus as defined in claim 9, further comprising an ejection correction device which:

when forming a second direction dot line of dots aligned in the second direction on the ejection receiving medium by depositing the droplets ejected from the nozzles onto the ejection receiving medium, while moving the ejection receiving medium relatively with respect to the liquid ejection head in the first direction by the conveyance device, and when the nozzles in the nozzle surface which correspond to the dots are tracked following an alignment sequence of the dots that are mutually adjacent in the second direction in the second direction dot line, then divides the nozzles into a nozzle group in which the nozzle which ejects the droplet forming a next dot in the alignment sequence is positioned on an upstream side in terms of the first direction, and a nozzle group in which the nozzle which ejects the droplet forming the next dot in the alignment sequence is positioned on a downstream side in terms of the first direction, and corrects an ejection state for each of the nozzle groups.

11. The liquid ejection apparatus as defined in claim 10, further comprising:

a head angle determination device which determines an installation angle of the liquid ejection head; and a correction amount control device which controls an amount of correction for correcting the ejection state, according to a determination result of the head angle determination device.

12. The liquid ejection apparatus as defined in claim 10, further comprising:

a medium angle determination device which determines an angle of conveyance direction of the ejection receiving medium by the relative movement with respect to the liquid ejection head; and a correction amount control device which controls an amount of correction for correcting the ejection state, according to a determination result of the medium angle determination device.

13. An image forming apparatus, comprising the liquid ejection apparatus as defined in claim 9, and forming an image on the ejection receiving medium by means of ink liquid ejected from the nozzles.

* * * * *